US012121114B2

(12) United States Patent
Amit et al.

(10) Patent No.: US 12,121,114 B2
(45) Date of Patent: Oct. 22, 2024

(54) TWO-STAGE CLASP MECHANISM FOR A WEARABLE DEVICE, AND RELATED SYSTEMS AND METHODS

(71) Applicant: Littebird Connected Care, Inc., Fall City, WA (US)

(72) Inventors: Gadi Amit, San Mateo, CA (US); Yuri Litvinov, San Mateo, CA (US)

(73) Assignee: LITTLEBIRD CONNECTED CARE, INC., Fall City, WA (US)

( * ) Notice: Subject to any disclaimer, the term of this patent is extended or adjusted under 35 U.S.C. 154(b) by 36 days.

(21) Appl. No.: 18/314,679

(22) Filed: May 9, 2023

(65) Prior Publication Data

US 2024/0099432 A1 Mar. 28, 2024

Related U.S. Application Data

(63) Continuation of application No. 18/073,370, filed on Dec. 1, 2022, now Pat. No. 11,684,126.

(60) Provisional application No. 63/285,039, filed on Dec. 1, 2021.

(51) Int. Cl.
*A44B 11/26* (2006.01)
*A44B 11/25* (2006.01)

(52) U.S. Cl.
CPC ..... *A44B 11/266* (2013.01); *A44B 11/2592* (2013.01)

(58) Field of Classification Search
CPC ..... A44B 11/266; A44B 11/2592; A44B 11/2573; A44B 11/2569; A44B 11/2593; Y10T 24/45728
See application file for complete search history.

(56) References Cited

U.S. PATENT DOCUMENTS

| | | | | |
|---|---|---|---|---|
| 2,513,592 | A | 7/1950 | Silverman | |
| 3,593,388 | A | 7/1971 | Coyle | |
| 2,908,243 | A | 9/1975 | Lou | |
| 4,001,923 | A | 1/1977 | Frankel | |
| 4,881,305 | A | 11/1989 | Rivera | |
| 7,380,979 | B2 * | 6/2008 | Hiranuma | A44C 5/14 368/282 |
| 11,399,601 | B2 * | 8/2022 | Sobol | A61B 5/681 |

* cited by examiner

*Primary Examiner* — Robert Sandy
(74) *Attorney, Agent, or Firm* — Perkins Coie LLP

(57) ABSTRACT

Two-stage clasp mechanisms, and related systems and methods, are disclosed herein. In some embodiments, the clasp mechanism includes a first housing portion, a second housing portion configured to connect to the first housing portion, and a locking mechanism configured to secure the first and second housing portions together. The locking mechanism can include a first striker carried by the second housing portion, a second striker movably carried by the first housing portion, and a blocking component movably carried by the second housing portion. The second striker is moveable along a first direction between an engaged position and a disengaged position with the first striker. The blocking component is movable along a second direction at an angle with respect to the first direction between a first position that prevents the first striker from moving and a second position that allows the second striker to move.

20 Claims, 14 Drawing Sheets

TWO-STAGE CLASP MECHANISM FOR A WEARABLE DEVICE, AND RELATED SYSTEMS AND METHODS

CROSS-REFERENCE TO RELATED APPLICATION(S)

The present application is a continuation of U.S. patent application Ser. No. 18/073,370, filed Dec. 1, 2022, which claims the benefit of U.S. Provisional Patent Application No. 63/285,039 by Gadi Amit, filed Dec. 1, 2021, the entirety of which is incorporated herein by reference. The present application is also related to U.S. Provisional Patent Application No. 63/260,440 by Monica Plath, filed Aug. 19, 2021, U.S. Provisional Patent Application No. 63/239,865 by Monica Plath, filed Sep. 1, 2021, and U.S. Provisional Patent Application No. 63/247,692 by Monica Plath, filed Sep. 23, 2021, U.S. patent application Ser. No. 17/891,781 by Monica Plath filed Aug. 19, 2022, and U.S. patent application Ser. No. 17/901,740 by Monica Plath filed Sep. 1, 2022, the disclosures of each of which are incorporated herein in their entirety by reference.

TECHNICAL FIELD

The present disclosure is generally directed to a clasp mechanism for securely fastening two components or parts together. In particular, the present technology is generally directed to a two-stage clasp mechanism that reduces the likelihood of unintentional release. In a specific example, the clasp can be used to secure the loose ends for wearable devices, jewelry, backpacks, luggage, and the like.

BACKGROUND

Clasps, also referred to as buckles, are devices that are used to secure two components and/or parts together (e.g., securing two loose ends, securing one loose end to a fixed part point, securing two components of an assembly together, and the like). In a typical clasp, a first component is attached to a second component and held by a catching mechanism in the clasp. Because of their simplicity, clasps are employed in a variety of settings. For example, they are often used in wearable devices (e.g., watches, smart watches, fitness monitors, location monitors, and the like), jewelry (e.g., bracelets, necklaces, anklets, earrings, and the like), other wearables (e.g., belts, clothing, shoes, slings, braces, helmets, and the like), bags (e.g., purses, backpacks, briefcases, fanny packs, luggage, and the like), harnesses, personal flotation devices and other vests, item straps, and/or in various other suitable settings. In a typical setting, the clasp (or buckle) is required to quickly connect and disconnect components and can provide some mechanism for adjusting where the components are connected (e.g., to adjust the tightness of the loose ends around an object). For example, a typical side release buckle has two joinable housing potions, sometimes referred to as a hook end and an insertion end, that can be adjustably secured to respective components. The hook end includes a center rod that guides the movement of the hook end and two spring arms that engage side holes on the insertion end. The buckle can be quickly engaged by inserting the hook end into the insertion end, and quickly disengaged by pinching the spring arms. However, because a typical the side release buckle must be designed to disconnect quickly, they can be easily unintentionally (e.g., accidentally, unwantedly, and the like) disconnected (e.g., by catching or bumping the spring arms on a foreign (e.g., external) object). This problem is common to typical clasps.

Figure 1A:
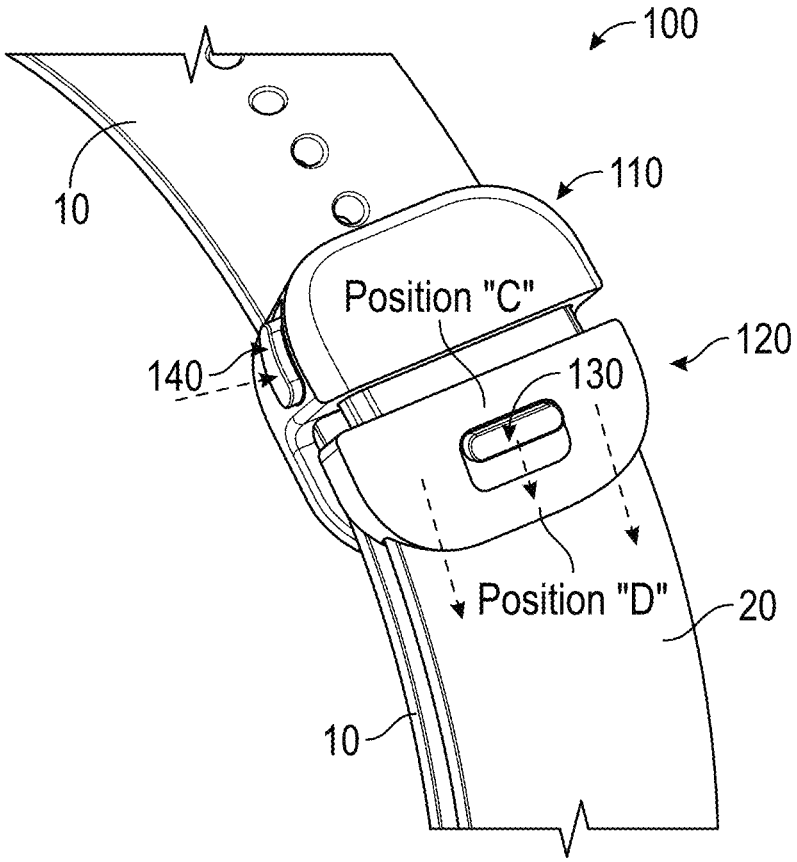
FIGS. 1A and 1B are isometric views of a two-stage clasp mechanism prior to and after disengagement, respectively, in accordance with some implementations of the present technology.

The drawings have not necessarily been drawn to scale. Similarly, some components and/or operations can be separated into different blocks or combined into a single block for the purpose of discussion of some of the implementations of the present technology. Moreover, while the technology is amenable to various modifications and alternative forms, specific implementations have been shown by way of example in the drawings and are described in detail below. The intention, however, is not to limit the technology to the particular implementations described.

DETAILED DESCRIPTION

Overview

Two-stage clasp mechanisms, and related systems and methods, are disclosed herein. In some implementations, the two-stage clasp mechanism (referred to as the "clasp mechanism") includes a first housing portion (sometimes also referred to herein as a "plug") and a second housing portion (sometimes also referred to herein as a "receptacle") joinable to the first housing portion. The clasp mechanism includes a locking mechanism carried by the first and second housing portions that requires a sequence of two actions (e.g., two stages) to release the second housing portion from the first housing portion. In particular, a user first pulls a sliding element accessible through an outer surface of the second housing portion from a first position to a second position. Second, while holding the sliding element in the second position, the user compresses a button accessible on an outer surface of the first housing portion. Once fully compressed, a first biasing mechanism within the second housing portion pushes the second housing portion away from the first housing portion, helping to ensure that the two housing portions fully disengage.

The sliding element (sometimes also referred to herein as an "action component," "sliding component," "actuator," "actionable component," and/or a "locking mechanism") is operably connected to a blocking component (sometimes also referred to herein as a "trap") within the second housing portion while the button (sometimes also referred to herein as a "latch," an "action component," "sliding component," "actuator," "actionable component," and/or a "locking mechanism") is operably connected to a first striker (sometimes also referred to herein as a "hooked striker," "hooked pin" and/or a "striker pin") within the first housing portion. The first striker is connected to (e.g., engaged with, hooked around, and the like) a second striker within the second housing portion, thereby locking the first and second housing portion together. The first striker can be moved away and disengaged from the second striker by compressing the button. However, when the sliding component is in the first position, the blocking component prevents the first striker from moving (and preventing the button from being compressed). As a result, the button cannot be compressed (and the first and second striker cannot be disengaged) until the sliding component is in the second position. Moving the sliding component to the second position moves the blocking component, thereby clearing space for the first striker to move into. Accordingly, as discussed above, the clasp mechanism requires a sequence of two actions to release the second housing portion from the first housing portion.

The two stages required to release the clasp mechanism can reduce the chance that the clasp mechanism is unintentionally disengaged. For example, because the button cannot be compressed until the slider is actioned to move the blocking component from the first position to the second position, the clasp cannot be released solely by accidental contact on the button. Additionally, the two stages can be difficult (or impossible) to complete with one hand. As a result, and purely by way of example, when the clasp is used to attach a wearable device to a person's wrist, the wearer is unable to detach the wearable device on their own. In a specific, non-limiting example, the two-stage clasp mechanism can prevent a child from detaching a wearable device on their wrist (e.g., thereby childproofing the clasp mechanism against unwanted (e.g., by a parent) detaching of the wearable device). In some embodiments, the button and slider are positioned on nonadjacent surfaces when the first and second housing portions are locked together (e.g., the slide is accessible on an upper surface while the button is accessible on a side surface, the button and slider are on opposite side surfaces, and the like). The nonadjacent positions can increase the difficulty of disengaging the clasp mechanism with a single hand and/or through accidental contact with the clasp mechanism, thereby further improving the security of the two-stage clasp.

In contrast, to join the two housing portions, a nose on the first housing portion (e.g., a protruding portion of the plug) is inserted into a port on the second housing portion (e.g., an opening). As the nose enters the port along a first direction, the second striker contacts and moves the first striker along a second direction, thereby automatically compressing the button. Further, as the first striker moves in the first direction, the first striker contacts and moves the blocker along a third direction opposite the first direction, thereby automatically moving the slider from the first position to the second position. Once the nose is fully inserted, the first striker is clear of the second striker, and a second biasing component (e.g., a spring, piston, and the like) pushes the first striker in a fourth direction opposite the second direction. As a result, the button is automatically decompressed and the first and second strikers are engaged. Once the button is decompressed and/or the first and second strikers are engaged, the first biasing mechanism pushes the blocker in the first direction and into position to prevent the first striker from moving. As a result, the sliding component is automatically moved from the second position to the first position. Once the sliding component is in the first position, the two housing portions of the clasp mechanism are securely engaged.

Thus, the clasp mechanism requires two actions to be disengaged, while only requiring a single action to be engaged. As a result, the clasp mechanism can provide a more secure connection of components (e.g., loose ends) coupled to the first and second housing portions without complicating the attachment process. The secure connection can help prevent accidental disengagement of a clasp mechanism on a wearable device (e.g., requiring more than an accidental contact on the button to disengage) and/or help childproof a wearable device or monitor (e.g., to prevent unwanted removal of the wearable device by a supervised person). Purely by way of example, the clasp mechanism can be employed by the wearable devices described in U.S. Provisional Patent Application No. 63/260,440 by Monica Plath, filed Aug. 19, 2021, and U.S. patent application Ser. No. 17/891,781 by Monica Plath filed Aug. 19, 2022, the entirety of each of which is incorporated herein in by reference. In this setting, in a specific example, the clasp mechanism can help ensure that a supervised person (e.g., a toddler, an elderly person, a differently abled person, etc.) does not accidentally (or intentionally) remove the wearable device when the wearable device is helping enforce a geofence boundary for a supervising person with responsibility over the supervised person.

For ease of reference, the clasp mechanism and the components therein are sometimes described herein with reference to top and bottom, upper and lower, upwards and downwards, and/or horizontal plane, x-y plane, vertical, or z-direction relative to the spatial orientation of the implementations shown in the figures. It is to be understood, however, that the clasp mechanism and the components therein can be moved to, and used in, different spatial orientations without changing the structure and/or function of the disclosed implementations of the present technology.

Further, although primarily discussed herein as a clasp mechanism to secure the loose ends of a wearable device for supervised persons, one of skill in the art will understand that the scope of the invention is not so limited. Rather the clasp mechanism can be used to secure any other components together in various other applications. Purely by way of example, the clasp mechanism can also be used in conjunction with various other wearable devices (e.g., watches, smart watches, fitness monitors, location monitors, and the like), jewelry (e.g., bracelets, necklaces, anklets, earrings, and the like), other wearables (e.g., belts, clothing, shoes, slings, braces, helmets, and the like), bags (e.g., purses, backpacks, briefcases, fanny packs, luggage, and the like), harnesses, personal flotation devices and other vests, item straps, assemblies, and/or in various other suitable settings.

Description of the Figures

Figure 1B:
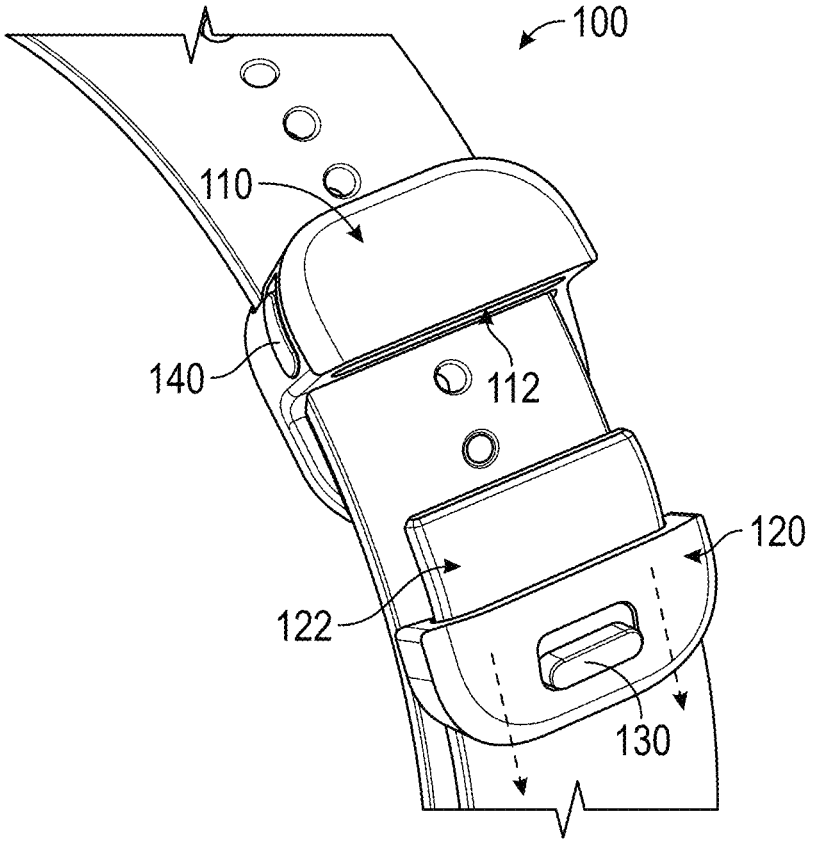

FIGS. 1A and 1B are isometric views of a two-stage clasp mechanism 100 prior to and after disengagement, respectively, in accordance with some implementations of the present technology. As illustrated in FIGS. 1A and 1B, the two-stage clasp mechanism 100 ("clasp mechanism 100") includes a first housing portion 110 and a second housing portion 120. The first housing portion 110 is operably coupleable to a first loose end 10 (e.g., illustrated as an adjustable-length strap) while the second housing portion 120 is operably coupleable to a second loose end 20 (e.g., illustrated as a fixed-length strap). As illustrated in FIG. 1A, the first and second housing portions 110, 120 can be joined (e.g., engaged, connected, affixed together, conjoined, and/or coupled together) to secure the first and second loose ends 10, 20 together. Purely by way of example, the first and second loose ends 10, 20 can be straps on a wearable device, and the first and second housing portions 110, 120 can be joined to secure the wearable device on a user's wrist.

Further, the first housing portion 110 includes a port 112 (sometimes also referred to herein as an opening) while the second housing portion 120 includes a nose 122 (sometimes also referred to herein as a protruding portion). To secure the clasp mechanism 100 together, a user positions the nose 122 within the port 112, thereby automatically actioning an internal locking mechanism 150 carried by the first and second housing portions 110, 120. Once securely joined, the user must sequentially perform two actions to disconnect (e.g., disengage, disjoin, decouple, and/or disunite) first and second housing portions 110, 120 of the clasp mechanism 100.

Figure 2A:
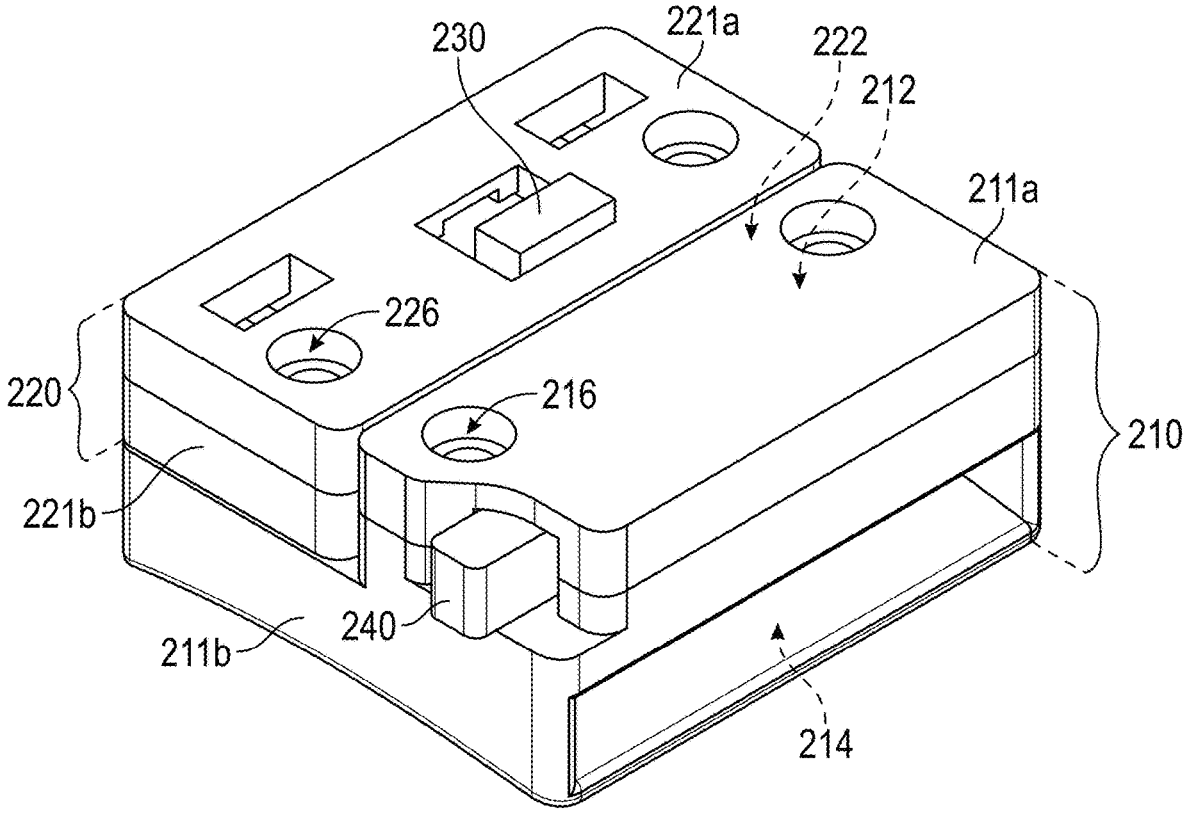
FIGS. 2A-2C are isometric views of a two-stage clasp mechanism at various points of disengagement in accordance with some implementations of the present technology.

In particular, the user must action both a sliding component 130 on the first housing portion 110 and a button 140 on the second housing portion 120. Compressing the button 140 in turn actions a component of the internal locking mechanism 150 within the clasp mechanism 100 to disconnect the first and second housing portions 110, 120. However, the button 140 cannot be compressed while a sliding component 130 is in a first position (e.g., "position C" in FIG. 1A, which is also illustrated in FIGS. 2A and 3A below). Accordingly, the user must first move a sliding component 130 from the first position to a second position (e.g., "position D" in FIG. 1A, which is also illustrated in FIGS. 1B, 2B, 3B, and 3C below), then compress the button 140 while the sliding component 130 is in the second position.

The two required stages of action can help improve the security of the connection of the first and second loose ends 10, 20 provided by the clasp mechanism 100. For example, the two required stages of action can help prevent accidental disengagement of the clasp mechanism (e.g., requiring more than an accidental contact on the button to disengage) since the button cannot be compressed via accidental contact without the slider also being actioned first. Additionally, or alternatively, the two required can help childproof the clasp mechanism 100 since the two actions can be difficult for a child to understand and/or complete to disengage the clasp mechanism 100. Further, as illustrated in FIG. 1A, each of the two stages of action occur in different directions (e.g., require movement in orthogonal axis, or axis at least angled with respect to each other) on nonadjacent surfaces of the clasp mechanism 100. The varying direction of the actions and/or the nonadjacent location of the actions can further reduce the chance of accidental disengagement and/or further childproof the clasp mechanism 100. Purely by way of example, the varying direction of the actions and/or the nonadjacent location of the actions prevents accidental contact with the clasp from performing both actions. In another example, a child may be unable to perform both actions, especially when the clasp mechanism 100 is used to secure something (e.g., a wearable device) to the child's wrist (thereby preventing them from using two hands to perform the actions).

As illustrated in FIG. 1B, once the button 140 is compressed and the internal locking mechanism 150 is unlocked, the second housing portion 120 can be disconnected and moved away from the first housing portion 110. In some implementations, the clasp mechanism 100 includes features that automatically move the second housing portion 120 away from the first housing portion 110 once the button 140 is compressed. Purely by way of example, the internal locking mechanism 150 can include a biasing mechanism (see FIGS. 3A-3D) operably connected to the sliding component 130 to bias the sliding component 130 toward the first position. Once the button is compressed, the biasing mechanism can push the second housing portion 120 away from the first housing portion 110 to return the sliding component 130 to the first position.

In some implementations, the first housing portion 110 is adjustably connected to the first loose end 10 and/or the second housing portion 120 is adjustably connected to the second loose end 20. For example, in the implementation illustrated in FIG. 1B, the first housing portion 110 includes a pin 128 that couples with one or more holes 12 on the first loose end 10 to secure the first housing portion 110 in position along the first loose end 10. The position can be adjusted by decoupling the pin 128 from the current hole, sliding the first loose end 10 through the first housing portion 110 to a desired position, then coupling the pin 128 to a new hole in the desired position. When the second housing portion 120 is joined with the first housing portion 110, the second housing portion 120 prevents the pin 128 from being decoupled with the current hole, thereby preventing the position from being adjusted while the clasp mechanism 100 is engaged (e.g., to prevent the adjustment from accidentally loosening straps while in use).

In various implementations, the first housing portion 110, the second housing portion 120, and/or the components of the internal locking mechanism 150 can include various rigid plastics, metals, silicon-based materials, ceramics, and/or various other suitable materials. Purely by way of example, the first and second housing portions 110, 120 can include a silicon coated surface to provide an antibacterial surface while the components of the internal locking mechanism 150 include a rigid plastic material.

Although the actionable components of the locking mechanism 150 are discussed and illustrated herein primarily as a slidable component and a button, one of skill in the art will understand that the actionable components are not so limited. Purely by way of example, the button can be replaced with a latch, a sliding element, a rotatable component, a lever, and/or various other suitable mechanisms to action a striker within the locking mechanism 150. Similarly, the slidable component can be replaced with a latch, a button, a rotatable component, a lever, and/or various other suitable mechanisms to action a blocking component within the locking mechanism 150.

Figure 2B:
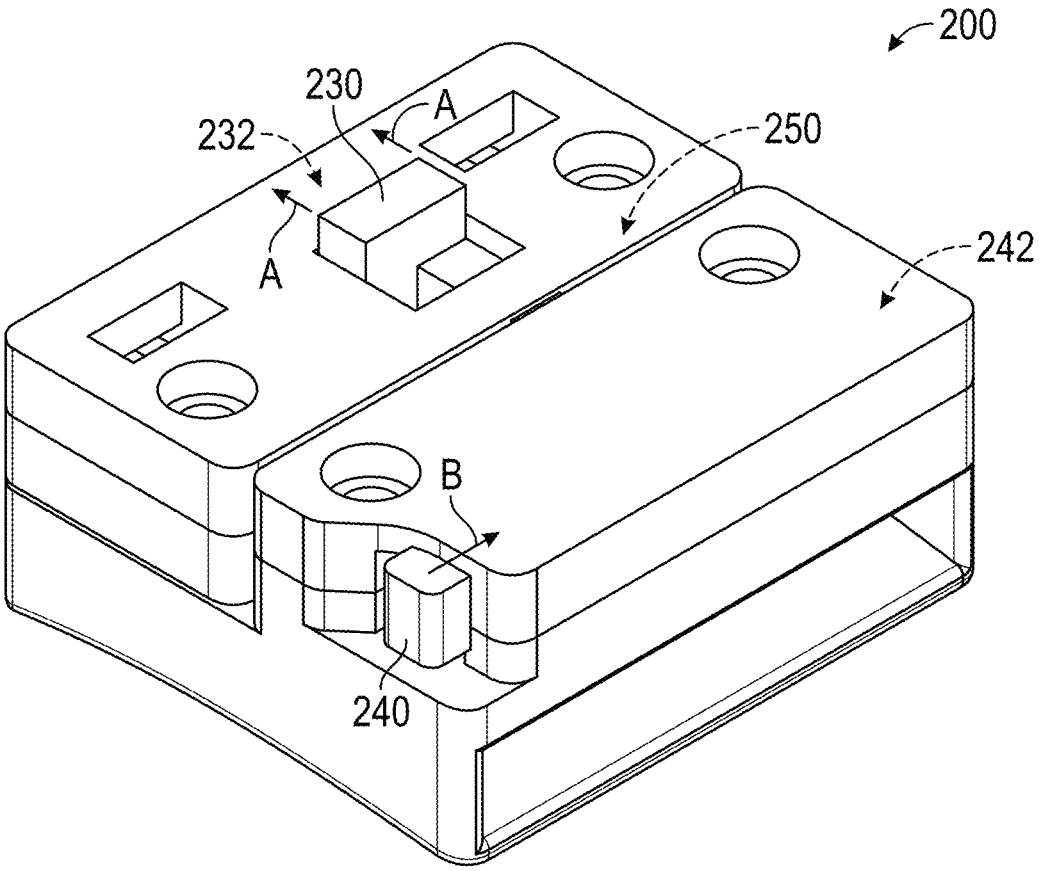
Figure 2C:
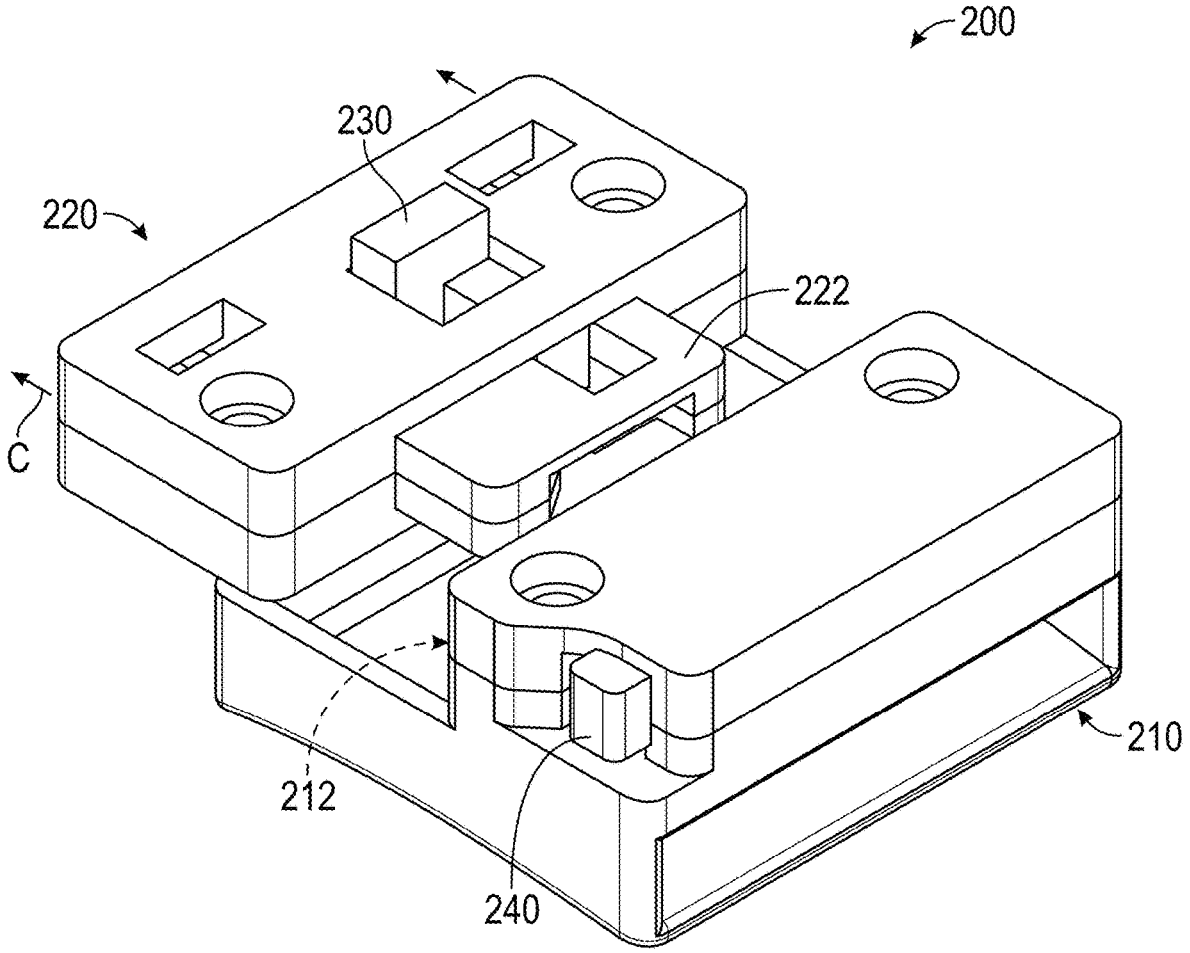
Figure 3A:
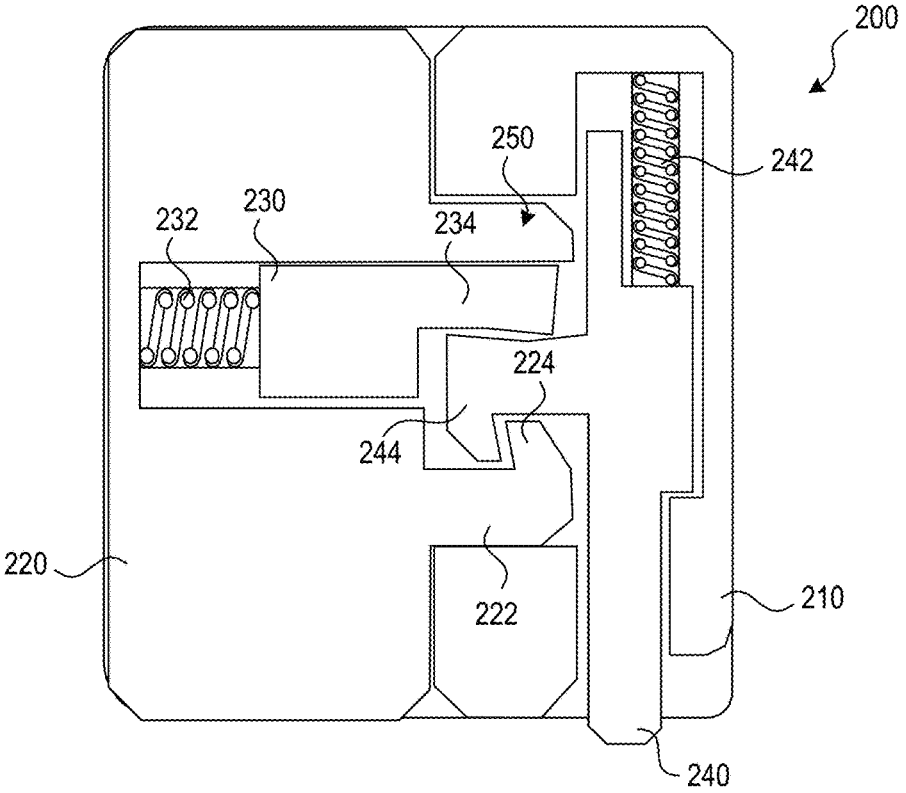
FIGS. 3A-3D are schematic top views of the two-stage clasp mechanism of FIG. 2A at various points of disengagement in accordance with some implementations of the present technology.

FIGS. 2A-2C are isometric views of a two-stage clasp mechanism 200 at various points of disengagement in accordance with some implementations of the present technology. As illustrated in FIG. 2A, the two-stage clasp mechanism 200 ("clasp mechanism 200") is generally similar to the clasp mechanism 100 discussed above with respect to FIGS. 1A and 1B. For example, the clasp mechanism 200 includes a first housing portion 210 and a second housing portion 220. Further, the second housing portion 220 can be joined to the first housing portion 210 by inserting a nose 222 of the second housing portion 220 into a port 212 of the first housing portion 210. Once the nose 222 is inserted into the port 212, a locking mechanism 250 carried by the first and second housing portions 210, 220 engages to secure the clasp mechanism 200 in a closed position (e.g., with the first and second housing portions 210, 220 joined together). To disengage the locking mechanism, as discussed in more detail below, a user actions both a sliding component 230 and a button 240.

In the implementation illustrated in FIG. 2A, the first housing portion 210 includes an upper component 211*a* and a lower component 211*b*. The upper and lower components 211*a*, 211*b* can be secured together by any suitable fastener (e.g., a screw, nut and bolt, nail, pin, clip, and the like; not shown) inserted into fastening holes 216 in the first housing portion 210. Similarly, the second housing portion 220 includes an upper component 221*a* and a lower component 221*b* that can be secured together by any suitable fastener inserted into fastening holes 226. The modular construction of the first and second housing portions 210, 220 allows the components of the locking mechanism 250 to be manufactured separate from the first and second housing portions 210, 220 before assembly. The modular construction also allows any of the components of the clasp mechanism 200 to be independently serviced and/or replaced. However, it will be understood that either of the first and second housing portions 210, 220 can be manufactured as a uniform body. Purely by way of example, the first housing portion 210 can be manufactured as a single piece and the components of the locking mechanism 250 (discussed in more detail below) can be inserted into the first housing 210 via the port 212 and/or another suitable opening.

As further illustrated in FIG. 2A, the clasp mechanism 200 can be manufactured separate from either of the first and second loose ends 10, 20 (FIG. 1A). For example, the first housing portion 210 includes a slot 213 to receive the first loose end 10, while the second housing portion includes a slot 223 to receive the second loose end 20. Accordingly, the clasp mechanism 200 can be deployed in any setting with loose ends suitable for the slots 213, 223. Further, the clasp mechanism 200 can be retroactively deployed in existing systems to secure a variety of loose ends.

FIGS. 2B and 2C illustrate the clasp mechanism 200 of FIG. 2A at various stages of the disengagement process. For example, as illustrated in FIG. 2B, the sliding component 230 has been moved from the first position to a second position along a first axis (indicated by a first path A), and the button 240 has been compressed along a second axis (indicated by a second path B). As a result, one or more striking components of the locking mechanism 250 are disengaged. As illustrated in FIG. 2C, the second housing portion 220 can move away from the first housing portion 210 along the first axis (indicated by a third path C) once the locking mechanism 250 is fully disengaged. Additional details on the striking components and functioning of the locking mechanism are discussed below.

FIGS. 3A-3D are partially schematic top views of the clasp mechanism 200 of FIG. 2A at various points of disengagement in accordance with some implementations of the present technology. In the illustrated implementations, the upper components 211*a*, 221*a* of the first and second housing portions 210, 220 (FIG. 2A) have been removed to illustrate the components of the locking mechanism 250.

As illustrated in FIG. 3A, the locking mechanism 250 includes a first striker 244 carried by the first housing portion 210, a second striker 224 carried by the second housing portion 220 and operably couplable to stop the first striker 244 (e.g., via corresponding hooks on the first and second strikers 244, 224), and a blocking component 234 carried by the second housing portion 220 and movably positioned adjacent the first striker 244. In the illustrated position, the blocking component 234 (sometimes also referred to herein as a "trap") prevents the first striker 244 from moving, thereby preventing the first and second strikers 244, 224 from disengaging. In the illustrated implementation, the blocking component 234 is coupled to the sliding component 230, and the sliding component 230 is operably coupled to a first biasing mechanism 232. The first biasing mechanism 232 can be a mechanical spring, gas spring, piston, and/or any other suitable mechanism that biases the sliding component 230 toward the first position (e.g., see FIG. 2A). As a result, the first biasing mechanism 232 also biases the blocking component 234 into the illustrated position to prevent first striker 244 from moving.

As further illustrated in FIG. 3A, first striker 244 is coupled to the button 240, which is operably coupled to a second biasing mechanism 242. The second biasing mechanism 242 can be a mechanical spring, gas spring, piston, and/or any other suitable mechanism that biases the button 240 toward a decompressed position. As a result, when the first and second housing portions 210, 220 are engaged, the second biasing mechanism 242 biases the first striker 244 into engagement with the second striker 224. Accordingly, even when the blocking component 234 is actioned along with the sliding component 230, the first striker 244 remains engaged with the second striker 224 until the button 240 is compressed. As a result, the locking mechanism 250 requires two separate actions on components of the locking mechanism 250 before the second housing portion 220 can be disengaged from the first housing portion 210.

As discussed above, the required two stages of action results in extra security for the clasp mechanism 200. For example, because the blocking component 234 prevents the first striker 244 from moving at all when the sliding component 230 is in the first position, the button 240 cannot be accidentally and/or unintentionally compressed. Further, as illustrated in FIG. 3A, the first biasing mechanism 232 is oriented in a first direction while the second biasing mechanism 242 is oriented in a second direction that is at an angle to the first direction. The angled orientations of the first biasing mechanism 232 and the second biasing mechanism 242 further reduces the chance that both actions to disengage the locking mechanism 250 accidentally and/or unintentionally occur. An additional result of the two stages of action and angled orientation is that it can be hard for a person of limited motor skills (e.g., an infant, toddler, and/or elderly person) disengage the clasp mechanism on their own. The limitation is especially strong if the person is limited to a single hand for performing both of the two stages of action (e.g., when the clasp is deployed on a wearable device around one of the person's wrists). Said another way, the two stages of action and angled orientation effectively childproof the clasp mechanism 200.

Figure 3B:
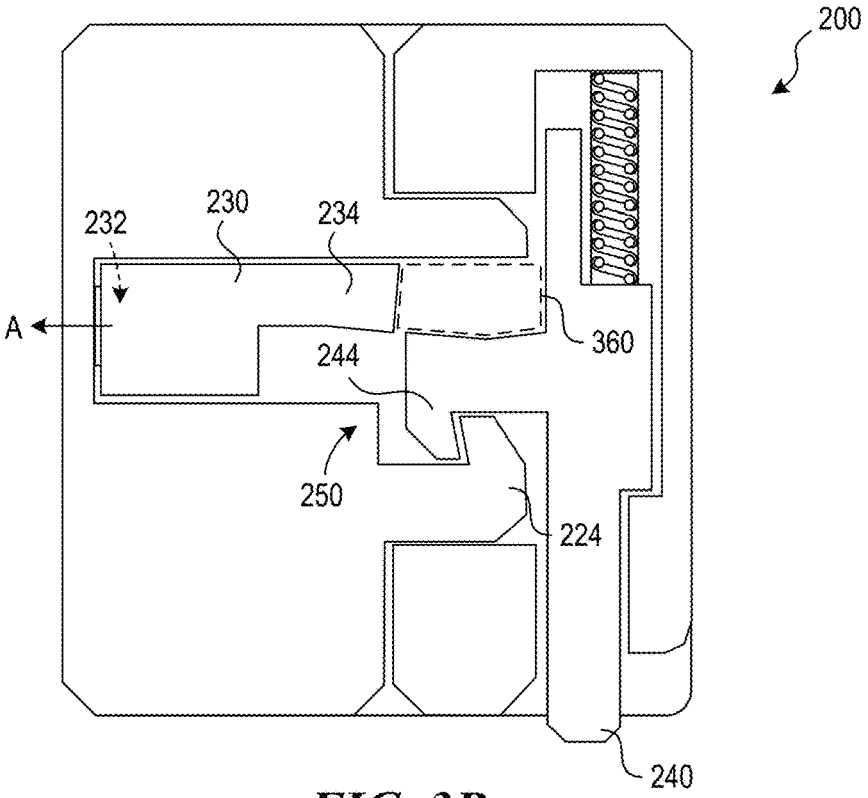

FIG. 3B illustrates the clasp mechanism 200 after the sliding component 230 has been moved from the first position to a second position along the first path A. As a result, the first biasing mechanism 232 is compressed and the blocking component 234 is moved away from the first striker 244. As a result, a space is cleared for the first striker 244 in a region 360 within the clasp mechanism 200. While the sliding component 230 is in the second position, the first biasing mechanism 232 attempts to decompress, thereby and applying a force that pushes the sliding component 230 back toward the first position. The decompression force therefore also pushes the blocking component 234 back toward the region 360, where the blocking component 234 would prevent the first striker 244 from moving. Accordingly, the sliding component 230 must be held in the second position while compressing the button 240 in order to unlock the clasp mechanism 200.

In various embodiments, the blocking component 234 can move along various other motion paths to clear a space in the region 360. Purely by way of example, the blocking component 234 can rotate around an axis out of the page to pivot between a first position occupying the region 360 and a second position out of the region 360. In this example, the first biasing mechanism 232 can be a torsion spring that pushes the blocking component 234 toward the first position while the sliding component 230 can be replaced by a knob and/or another suitable rotating mechanism to action the blocking component 234.

Figure 3C:
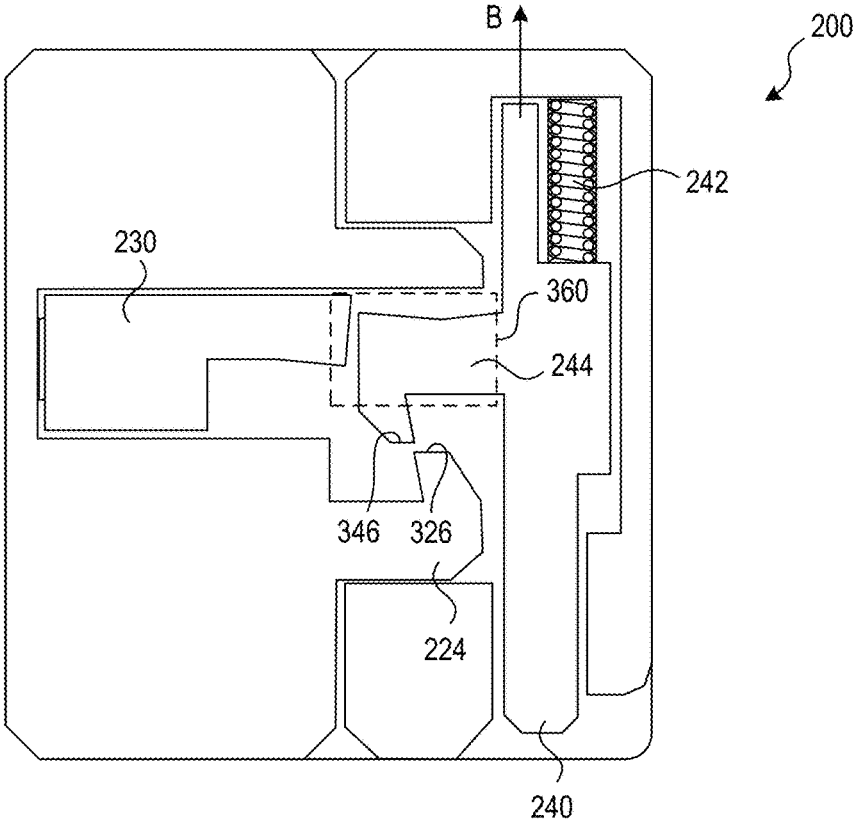

FIG. 3C illustrates the clasp mechanism 200 after the button 240 has been compressed along the second path B. As a result, the second biasing mechanism 242 is compressed and the first striker 244 is moved into the region 360. As the first striker 244 moves into the region 360, a distal end 346 of the first striker 244 is moved along the second path B away from a distal end 324 of the second striker 224. Once the distal end 346 of the first striker 244 is fully clear of the distal end 326 of the second striker 224, the locking mechanism 250 is fully disengaged. As a result, the clasp mechanism 200 is unlocked.

In various embodiments, the first striker 244 can move along various other motion paths to disengage with the second striker 224. Purely by way of example, the first striker 244 can rotate through the region 360 to move between a first position engaged with the second striker 224 and a second position disengaged with the second striker 224. In this example, the second biasing mechanism 242 can be a torsion spring that pushes the first striker 244 toward the first position while the button 240 can be replaced by a knob and/or another suitable rotating mechanism to action the first striker 244.

Figure 3D:
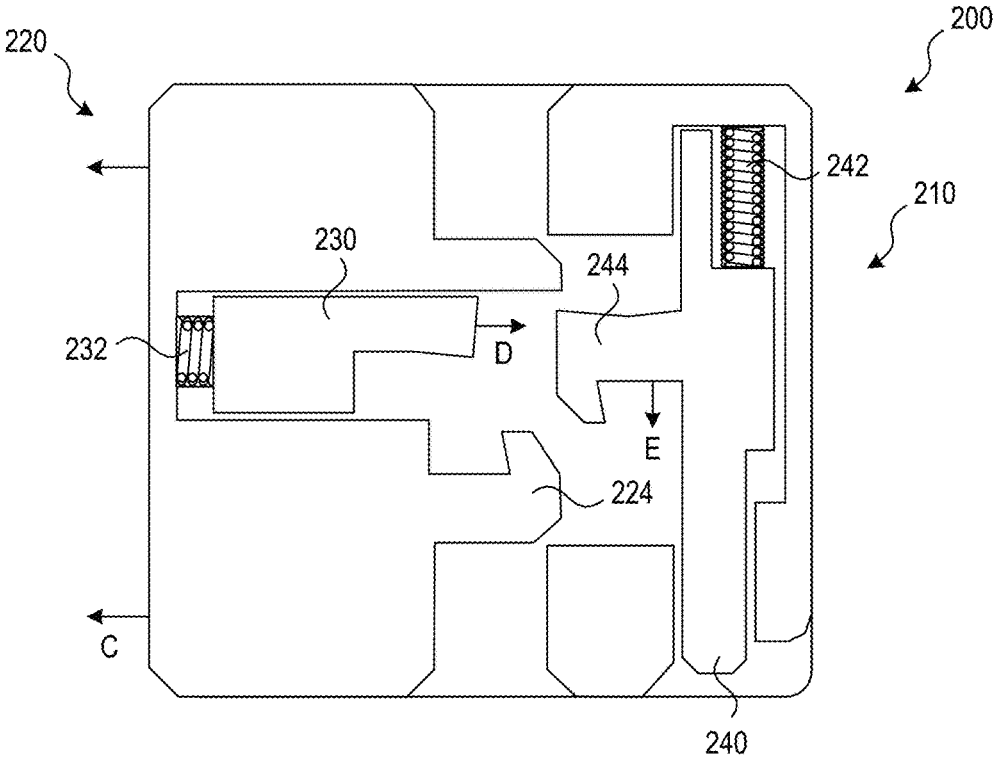

FIG. 3D illustrates the clasp mechanism 200 after the locking mechanism 250 is fully disengaged and the first and second biasing mechanism 232, 242 are allowed to partially decompress. For example, as illustrated, the first biasing mechanism 232 decompresses by pushing the second housing portion 220 away from the first housing portion 210 along the third path C. Accordingly, once the locking mechanism 250 is disengaged by the two actions discussed above, the clasp mechanism 200 automatically moves to disconnect the first and second housing portions 210, 220. Further, as the second housing portion 220 moves, the second striker 224 is moved away from the first striker 244, thereby preventing the locking mechanism 250 from reengaging.

As further illustrated in FIG. 3D, once the first and second housing portions 210, 220 are disconnected, the sliding component 230 and the button 240 can be released. Once the sliding component 230 is released, the first biasing mechanism 232 continues to decompress and pushes the sliding component 230 to the first position along a fourth path D. Similarly, once the button 240 is released, the second biasing mechanism 242 decompresses and pushes the button 240 and the first striker 242 back along a fifth path E.

In the implementations illustrated in FIGS. 3A-3C, the second striker 224 is built into (e.g., integrated with) the nose 222 of the second housing portion 220. However, it will be understood that the second striker 224 can be an additional component in the second housing portion 220. Similarly, in the illustrated implementation, the blocking component 234 and the sliding component are illustrated as an integral component while the first striker 244 and the button 240 are illustrated as an integral component. However, it will be understood that the blocking component 234 can be a separate component from and operably coupled to the sliding component 230 and/or that the first striker 244 can be a separate component from and operably coupled to the button 240.

Figure 4A:
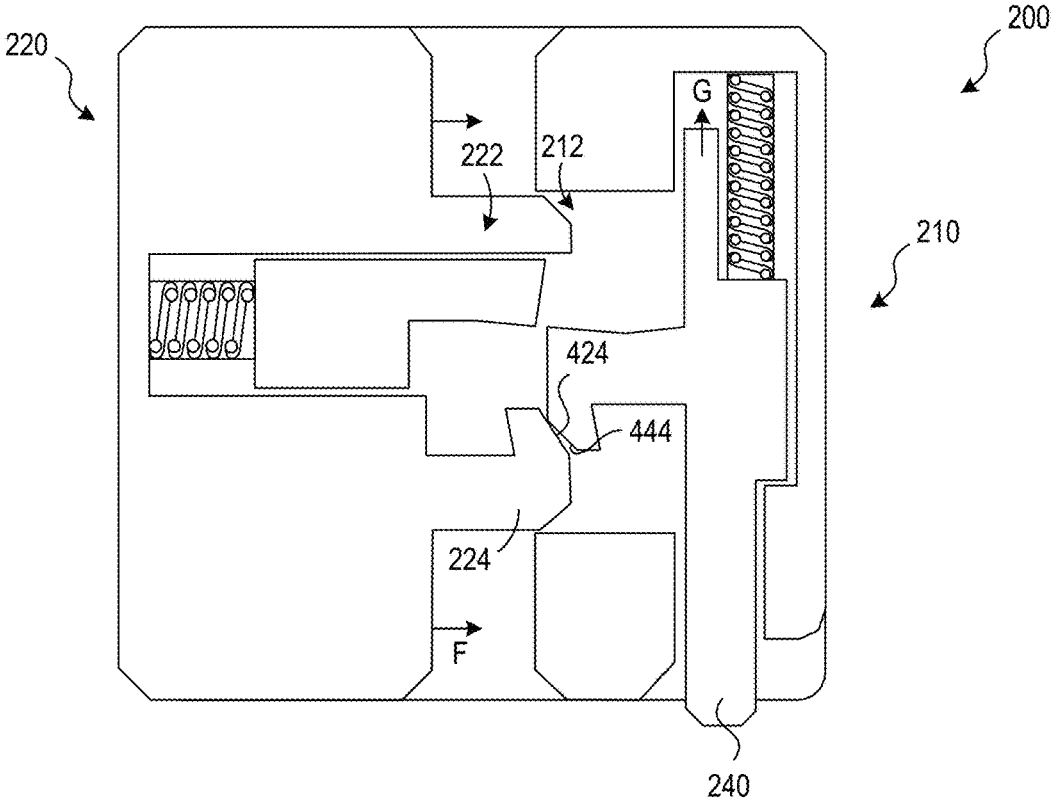
FIGS. 4A-4C are schematic top views of the two-stage clasp mechanism of FIG. 2A at various points of engagement in accordance with some implementations of the present technology.
Figure 4B:
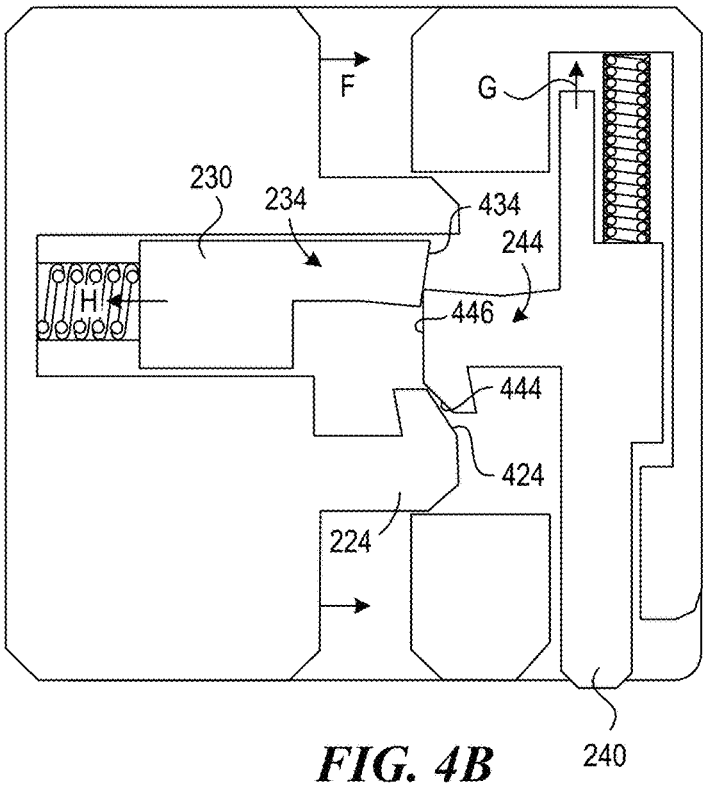
Figure 4C:
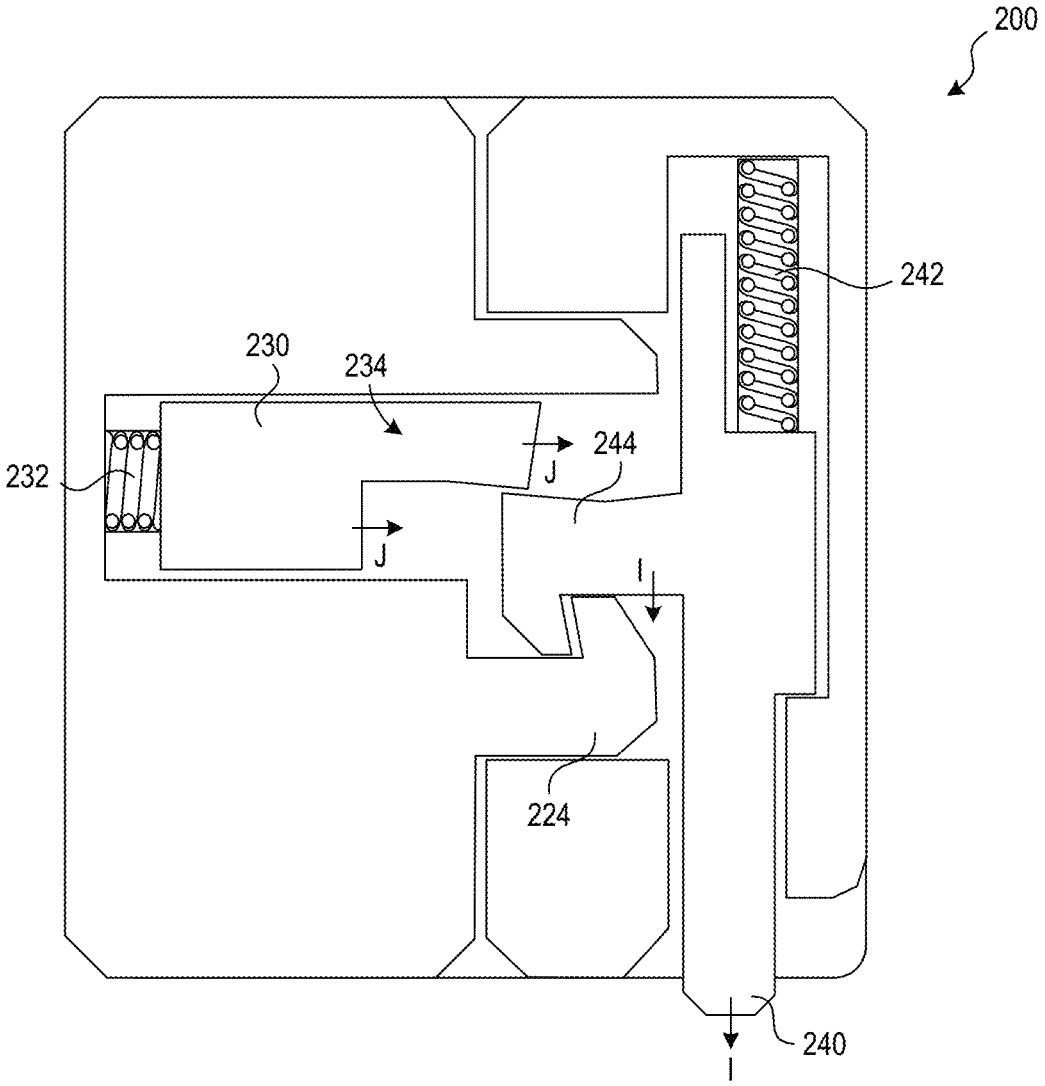

FIGS. 4A-4C are schematic top views of the clasp mechanism 200 of FIG. 2A at various points of an engagement process in accordance with some implementations of the present technology. In the illustrated implementations, the upper components 211*a*, 221*a* of the first and second housing portions 210, 220 (FIG. 2A) have been removed to illustrate the components of the locking mechanism 250.

FIG. 4A illustrates the clasp mechanism 200 right after the nose 222 of the second housing portion 220 has been inserted into the port 212 of the first housing portion 210. As the second housing portion 220 continues to move along a sixth path F (further inserting the nose 222 into the port 212), a surface 424 at a distal region of the second striker 224 contacts a surface 444 at a distal region of the first striker 244. At least one of the surfaces 424, 444 is sloped (both are sloped in the illustrated embodiment) such that further movement of the second housing portion 220 along the sixth path F (e.g., further inserting the nose 222 into the port 212) pushes the first striker 244 along a seventh path G. As a result, further inserting the nose 222 into the port 212 causes the second biasing mechanism 242 to compress and causes the button 240 to move along the seventh path G (e.g., thereby actioning the button 240).

FIG. 4B illustrates the clasp mechanism 200 after the nose 222 has been inserted into the port 212 and the first striker 244 has moved along the seventh path G. As illustrated, as the first striker 244 continues to move, a second surface 446 of the first striker 244 contacts a distal surface 434 of the blocking component 234. Further insertion of the nose 222 into the port 212 along the sixth path F pushes the blocking component 234 along an eighth path H to provide the first striker 244 with space to engage with the second striker 224. In various embodiments, at least one of the surfaces 446, 434 is sloped such to aid the first striker 244 in pushing the blocking component 234 along an eighth path H (e.g., by transitioning some of the movement along the seventh path G into the eight path H). The movement of the blocking component 234 along the eighth path H moves the blocking component 234 and compresses the first biasing mechanism 232 (e.g., thereby actioning the sliding component 230). As a result, the single action of inserting the nose 222 into the port 212 (e.g., bringing the clasp mechanism together) can action both the sliding component 230 and the button 240.

The motion of both the sliding component 230 and the button 240 described above continues until the surface 444 of the first striker 244 is fully clear of the surface 424 of the second striker 224. At this point, further inserting the nose 222 into the port 212 only moves the sliding component 230 while the hooked ends of the first and second strikers 244, 224 move past each other. This motion continues until the hooked ends are clear from each other, at which point the second biasing mechanism 242 causes the first striker 244 and the button 240 to move along a ninth path I illustrated in FIG. 4C.

As illustrated in FIG. 4C, the movement of the first striker 244 along the ninth path I causes the first and second strikers 244, 224 to engage, thereby securing the first and second housing portions 210, 220 together. Further, once the first and second strikers 244, 224 are engaged, the second surface 446 of the first striker 244 is clear from contacting the distal surface 434 of the blocking component 234. As a result, the first biasing mechanism can decompress and push the sliding component 230 and the blocking component 234 along a tenth path J. As the blocking component 234 moves along the tenth path J, it occupies the region 360 (FIG. 3B) behind the first striker 244, thereby removing any space for the first striker 244 to move into to disengage with the second striker 224.

The result of the discussion above is that a single action (e.g., moving the first housing portion along the sixth path F to insert the nose 222 into the port 212) automatically performs both actions necessary to reengage the clasp mechanism 200. Further, once the nose 222 is fully inserted into the port 212, the first and second biasing mechanisms 232, 242 automatically engage and/or lock the clasp mechanism 200. Accordingly, once the nose 222 is fully inserted into the port 212, the user must perform both of the actions discussed above to disengage and/or unlock the clasp mechanism 200.

Figure 5:
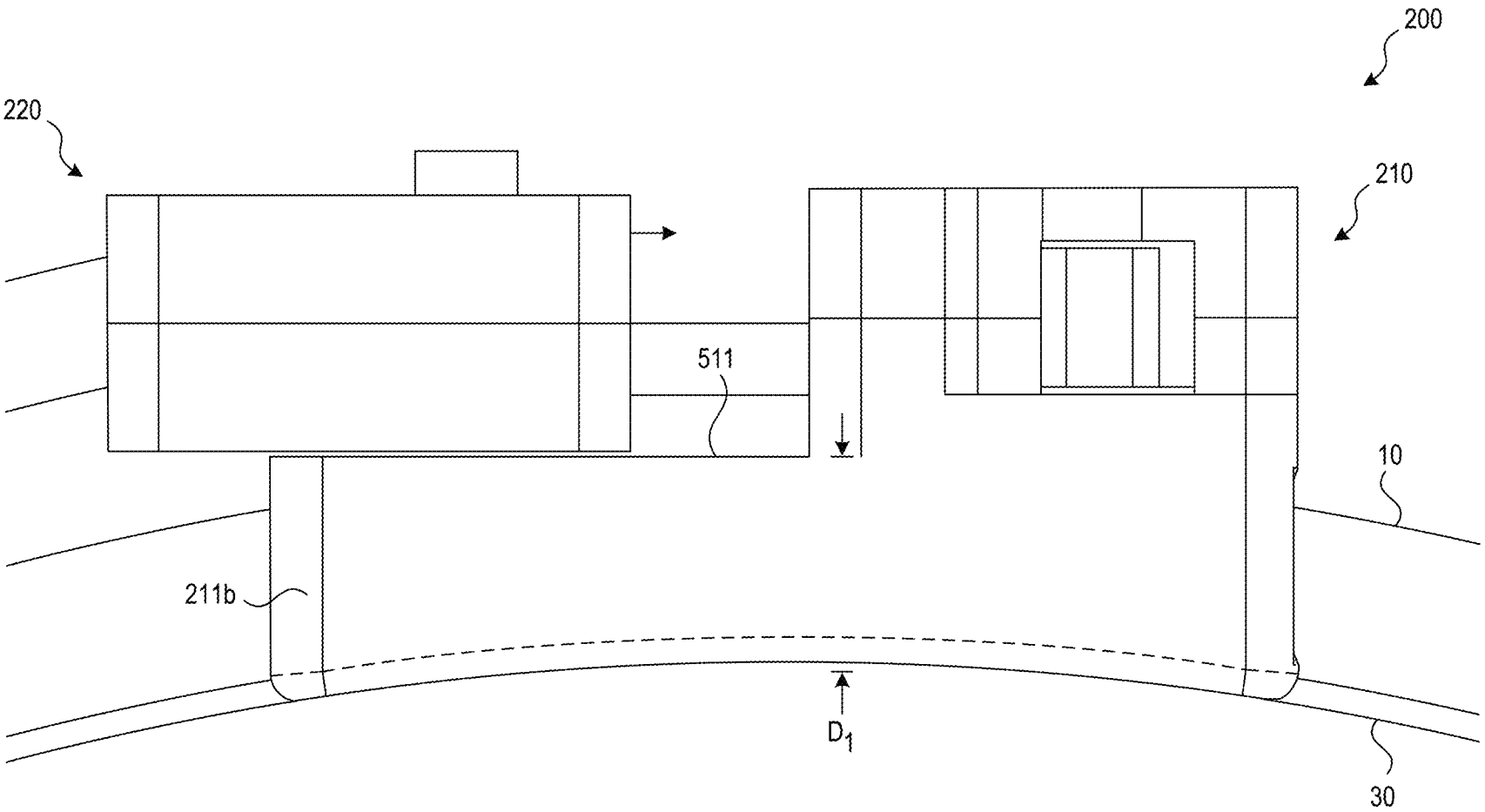
FIG. 5 is a side view of the two-stage clasp mechanism of FIG. 2A used in conjunction with a wearable device in accordance with some implementations of the present technology.

FIG. 5 is a side view of the clasp mechanism 200 of FIG. 2A being engaged in accordance with some implementations of the present technology. In the illustrated implementation, the clasp mechanism 200 is being used in conjunction with a wearable device on the user's wrist 30. For example, the first housing portion 210 is adjustably attached to the first loose end 10 (e.g., an adjustable wrist strap) while the second housing portion 220 is attached to the second loose end 20 (e.g., a non-adjustable wrist strap), where the first and second loose ends 10, 20 can be connected to the wearable device to secure the device on the user's wrist 30.

As discussed in more detail above, engaging the clasp mechanism 200 can include inserting the nose 222 of the second housing portion 220 into the port 212 of the first housing portion 210, thereby actioning the components of the locking mechanism 250. As illustrated in FIG. 5, The first housing portion 210 can include a guiding surface 511 (e.g., a horizontal middle surface, a mesa, and/or a sliding surface) that supports the second housing portion 220 above the user's wrist 30 by a distance $D_1$. The distance $D_1$, via the portion of the first housing portion 210 beneath the guiding surface 511, separate the user's wrist 30 from the engagement process. The separation can help protect the user's wrist 30 from any pinching, friction from movement, and/or clipping between the first and second housing portions 210, 220 as they engage. Accordingly, the guiding surface 511, and the portion of the first housing portion 210 beneath the guiding surface 511, can help improve the safety and convenience of the clasp mechanism 200 when deployed in wearable devices. In a specific, non-limiting example, the guiding surface 511 (and the protection provided therein), can help protect a supervised person's wrist from being pinched as a parent or guardian applies the wearable device to the supervised person. The protection can be especially helpful in this setting due to the more sensitive skin of supervised persons and/or their possible non-compliance when the wearable device is being applied.

Figure 6:
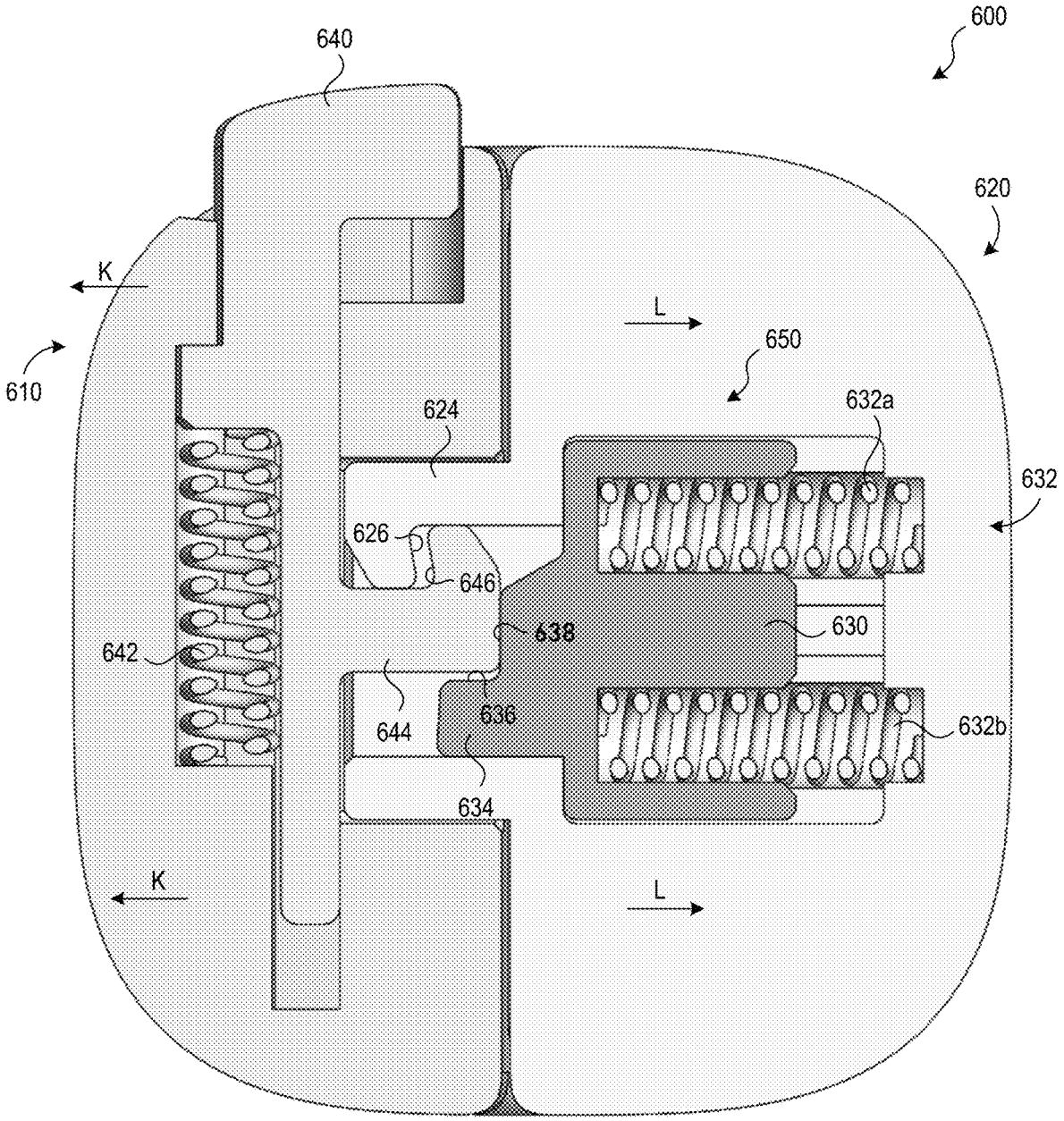
FIG. 6 is a schematic top view of a two-stage clasp mechanism in accordance with further implementations of the present technology.

FIG. 6 is a schematic top view of a two-stage clasp mechanism 600 in accordance with further implementations of the present technology. As illustrated in FIG. 6, the two-stage clasp mechanism 600 ("clasp mechanism 600") is generally similar to the clasp mechanisms 100, 200 discussed above with respect to FIGS. 1A-4C. For example, the clasp mechanism 600 includes a first housing portion 610 and a second housing portion 620. Further, the second housing portion 620 can be securely joined to the first housing portion 610 by a locking mechanism 650 between the first and second housing portions 610, 620. In the illustrated implementation, the upper components and/or surface of first and second housing portions 610, 620 (e.g., the upper components 211*a*, 221*a* discussed above with respect to FIG. 2A) have been removed to illustrate the components of the locking mechanism 650. Similar to the locking mechanisms discussed above, the locking mechanism 650 includes a first striker 644, a second striker 624, and a blocking component 634. The blocking component 634 is coupled to a sliding component 630 and biased toward the illustrated position by a first biasing mechanism 632. The first striker 644 is coupled to a button 640 and biased toward the illustrated position by a second biasing mechanism 642. To disengage the locking mechanism, as discussed in more detail above, a user actions both the sliding component 630 and the button 640.

In the illustrated implementation, however, the first biasing mechanism 632 includes two components (labeled individually as 632*a* and 632*b*), instead of the singular components illustrated above. The dual components of the first biasing mechanism 632 can help ensure that the sliding component 630 is biased by a balanced, sufficient pressure to prevent accidental disengagement. Further, the balanced application of force from the first biasing mechanism 632 can help ensure that the sliding component 630 has a relatively smooth action as it is pulled back and released. In various implementations, the first biasing mechanism 632 can include any suitable number of components to help facilitate the balanced, sufficient pressure and/or smooth operation of the sliding component 630. Further, it will be understood that the second biasing mechanism 642 can also include multiple components to help ensure a balanced, sufficient pressure and/or smooth operation of the button 640.

As further illustrated in FIG. 6, the first striker 644 includes a first engagement surface 646 that is positively engaged with a second engagement surface 626 on the second striker 624. That is, the first and second engagement surfaces 646, 626 are sloped such that the first and second strikers 644, 624 cannot slide away from each other when the clasp mechanism 600 is subject to forces along eleventh and twelfth paths K, L. As a result, the components of the locking mechanism 650 do not move to break away from each other even when a significant force is applied to the clasp mechanism 600 along the eleventh and twelfth paths K, L. This can increase the security of the engagement between the first and second housing portions 610, 620. Accordingly, the illustrated implementation can be useful in settings where break-away features are not needed for the safety of the clasp mechanism 600 (e.g., no chance of harm when the clasp mechanism does not break away). Purely by way of example, the illustrated implementation can be especially useful when the clasp mechanism 600 is deployed on bags (e.g., luggage, backpacks, handbag, purses, and the like). However, the lack of a break-away feature can also result in a catastrophic failure when the force becomes large enough (e.g., components in the locking mechanism 650 fully break).

Figure 7:
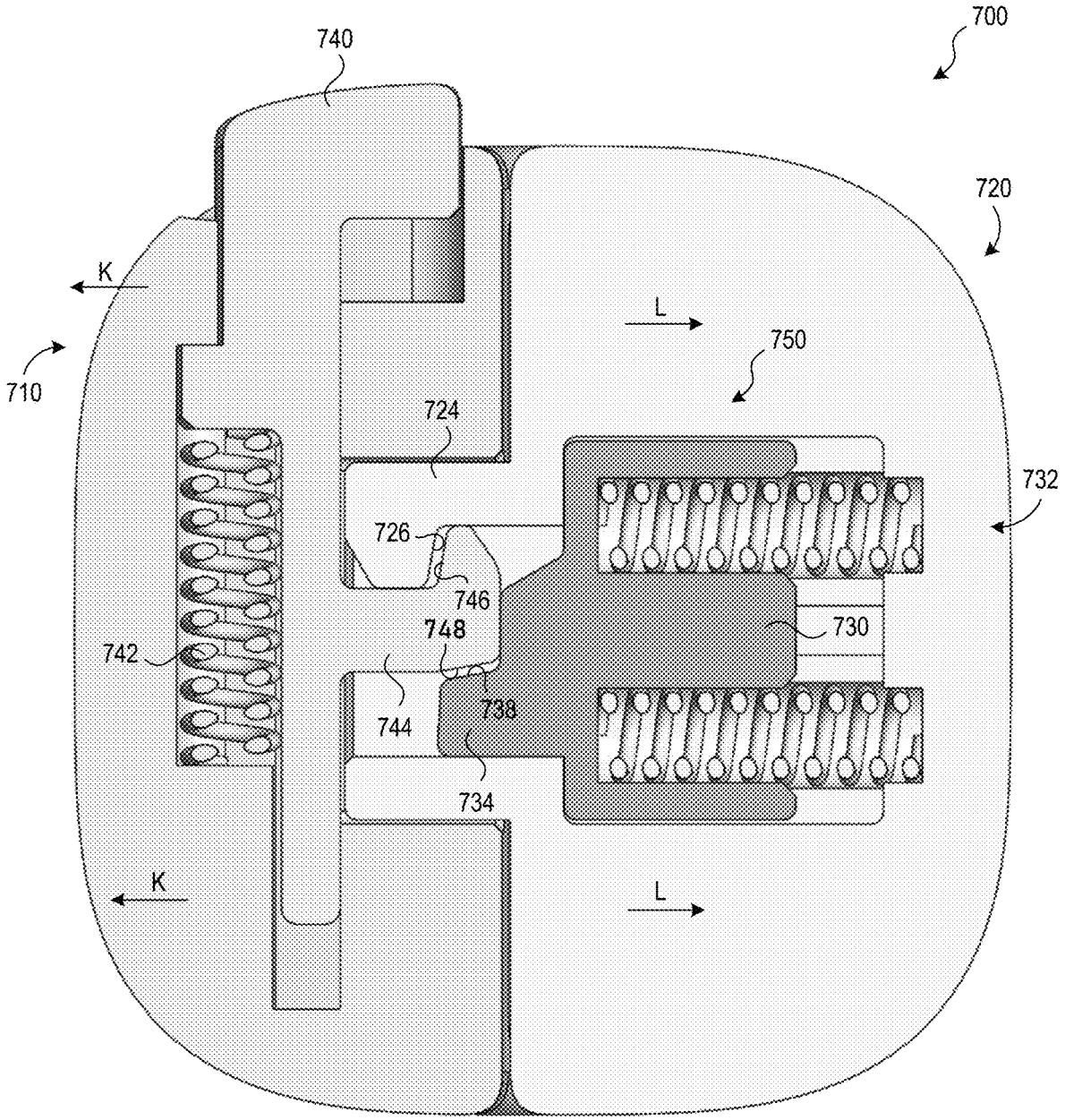
FIG. 7 is a schematic top view of a two-stage clasp mechanism with break-away features in accordance with further implementations of the present technology.

FIG. 7 is a schematic top view of a two-stage clasp mechanism 700 with break-away features in accordance with further implementations of the present technology. As illustrated in FIG. 7, the two-stage clasp mechanism 700 ("clasp mechanism 700") is generally similar to the clasp mechanism 600 discussed above with respect to FIG. 6. For example, the clasp mechanism 700 includes a first housing portion 710 and a second housing portion 720 that can be securely joined together by a locking mechanism 750.

Further, similar to the locking mechanisms discussed above, the locking mechanism 750 includes a first striker 744, a second striker 724, and a blocking component 734. The blocking component 734 is coupled to a sliding component 730 and biased toward the illustrated position by a first biasing mechanism 732. The first striker 744 is coupled to a button 740 and biased toward the illustrated position by a second biasing mechanism 742. To disengage the locking mechanism, a user actions both the sliding component 730 and the button 740.

In the illustrated implementation, however, the locking mechanism 750 is configured to break away (e.g., disengage) when a sufficient separation force (sometimes also referred to herein as a "release force") is applied to the clasp mechanism 700. For example, the first striker 744 includes a first engagement surface 746 that is negatively engaged with a second engagement surface 726 on the second striker 724. That is, the first and second engagement surfaces 746, 726 are sloped such that the first and second strikers 744, 724 can slide away from each other when the clasp mechanism 700 is subject to a sufficient separation force along the eleventh and twelfth paths K, L. Further, the first striker 744 includes a third engagement surface 748 that is negatively engaged with a fourth engagement surface 738 on the blocking component 730. That is, the third and fourth engagement surfaces 748, 738 are sloped such that the first striker 744 can push the blocking component 730 out of the region 360 as the first and second strikers 744, 724 slide away from each other. As a result, when a sufficiently large separation force is applied to the clasp mechanism 700 along the eleventh and twelfth paths K, L, the locking mechanism 750 can disengage without the user actioning both the sliding component 730 and the button 740. The disengagement allows the first and second housing portions 710, 720 to break away from each other without damaging any of the components of the locking mechanism 750.

The magnitude of the force required to disengage the locking mechanism 750 is impacted by the coefficient of static friction between the first and second engagement surfaces 746, 726 (e.g., the force required to overcome static friction and start moving); the relative slope of the first and second engagement surfaces 746, 726 with respect to each other (e.g., how negative the engagement between the first and second strikers 744, 724 is); the compressive strength and/or spring constant of the second biasing mechanism 742 (e.g., impacting the force required to compress the second biasing mechanism as the first striker 744 moves); the coefficient of static friction between the third and fourth engagement surfaces 748, 738; the relative slope of the third and fourth engagement surfaces 748, 738; and/or the compressive strength and/or spring constant of the first biasing mechanism 732. Accordingly, material selection and the customization of the orientation of the surfaces can adjust the magnitude of the separation force required to disengage the locking mechanism 750.

Purely by way of example, the magnitude can be reduced by selecting materials with relatively low-friction surfaces, increasing the negativity of the engagement between the first and second strikers 744, 724, increasing the negativity of the engagement between first striker 744 and the blocking component 734, and/or reducing the spring constant of the first and/or second biasing mechanism 732, 742. Conversely, the magnitude can be increased by selecting materials with relatively high-friction surfaces, decreasing the negativity of the engagement between the first and second strikers 744, 724, decreasing the negativity of the engagement between first striker 744 and the blocking component 734, and/or increasing the spring constant of the first and/or second biasing mechanisms 732, 742.

In various embodiments, the magnitude of the force required to disengage the locking mechanism 750 can be predetermined (by any of the customizations discussed above) to be between about 2 kilograms (kg) and about 25 kg, between about 5 kg and about 15 kg, or about 7 kg. In various embodiments, the components of the locking mechanism 750 can include various rigid plastic materials, metals, silicon-based materials, ceramics, and/or various other rigid materials.

In some implementations, the break-away features increase the safety of the clasp mechanism 700. Purely by way of example, the break-away features can be useful when the clasp mechanism 700 is deployed on a wearable device to avoid the strap from being caught on a foreign object and hurting the user. In a specific, non-limiting example, the break-away features could protect a supervised person's wrist from being hurt when the straps of a wearable device catch on something (e.g., on a portion of a slide at the playground) by disengaging the locking mechanism 750 at a relatively safe force magnitude (e.g., below a magnitude that could cause minor and/or serious injury). Additionally, or alternatively, the break-away features can increase the lifetime of the clasp mechanism 700 by allowing the components of the locking mechanism 750 to disengage before they break.

Figure 8A:
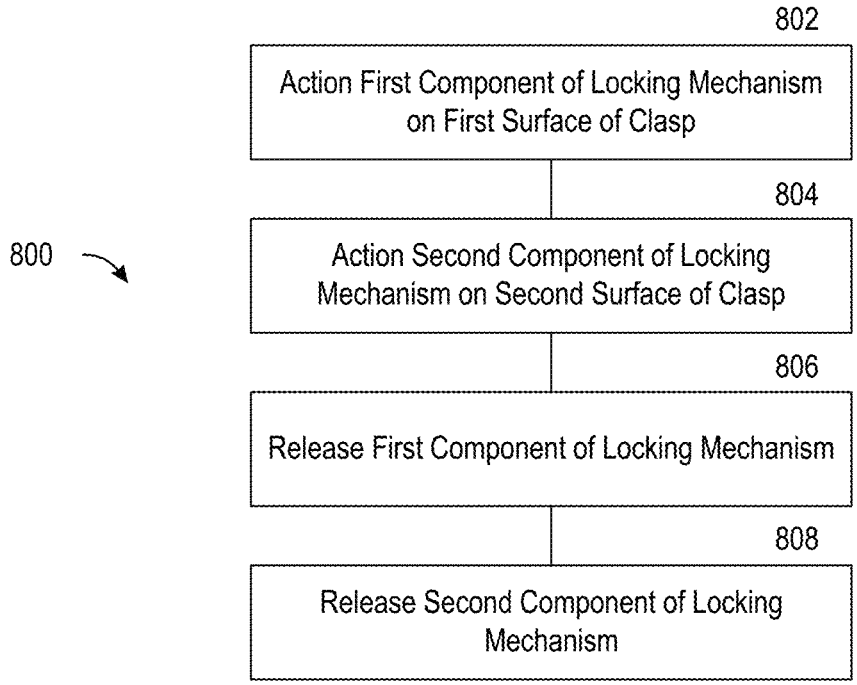
FIGS. 8A and 8B are a flow diagrams of processes for operating a two-stage clasp mechanism in accordance with some embodiments of the present technology.

FIG. 8A is a flow diagram of a process 800 for operating a two-stage clasp mechanism in accordance with some embodiments of the present technology. The flow diagram of the process 800 illustrates the steps discussed above for a user to disengage the locking mechanism of any of the clasp mechanisms discussed above with respect to FIGS. 1A-7.

The process 800 begins at block 802 with the user actioning a first component of a locking mechanism on a first surface of the clasp mechanism. As an example, the first component can be the blocking component discussed above with respect to FIGS. 2A-3D. Accordingly, as discussed above, the first component can be actioned by moving the sliding component from a first position to a second position on an upper surface of the clasp mechanism. However, it will be understood that the exact shape and/or actioning mechanism of the first component of the locking mechanism can vary between embodiments. Purely by way of example, the blocking component can include various other geometries and/or can be movable along various other axes. In a specific, non-limiting example, the first component can be actioned by movement of an analogous sliding component in a vertical direction (e.g., rather than the horizontal direction discussed above) to move out of the way for the second component to be actioned.

At block 804, while the user maintains the first component in the actioned position, the user actions the second component of the locking mechanism on a second surface of the clasp mechanism. As discussed above, when the second surface is different from the first surface, the overall security of the locking mechanism can be improved (e.g., because it is harder for a single accidental bump to action both components). Continuing the example from above, the second component can be the first striker discussed above with respect to FIGS. 2A-3D. Accordingly, the second component can be actioned by compressing the button on a side surface of the clasp mechanism. However, it will be understood that the exact shape and/or actioning mechanism of the second component can vary between embodiments. Purely by way of example, the first striker can include various other geometries and/or can be movable along various other axes.

In a specific, non-limiting example, the first striker can move in a vertical direction (e.g., rather than the discussed horizontal direction) to disengage the locking mechanism.

Once the actioning is completed in sequence in blocks 802 and 804, the locking mechanism of the clasp will disengage. Next, at blocks 806 and 808, the user can release the first and second components of the locking mechanism, respectively. As discussed above, the clasp mechanism includes internal elements that bias the first and second components back toward a resting state. Accordingly, for example, once the first component is released, the first component moves back toward the first position. As a result of the automatic movement after the clasp is released at blocks 806 and 808, the locking mechanism will reengage if the first and/or second component are not maintained in the actioned position until the locking mechanism is fully disengaged. As a result, it can be harder to accidentally and/or unwittingly disengage the locking mechanism (e.g., a person of limited motor skills and/or limited to a single hand may, desirably, be unable to disengage the locking mechanism alone). It will be understood that, in some embodiments, the release of first and second components of the locking mechanism in blocks 806 and 808 can occur in a single action (e.g., when the user lets go of both components at once).

Figure 8B:
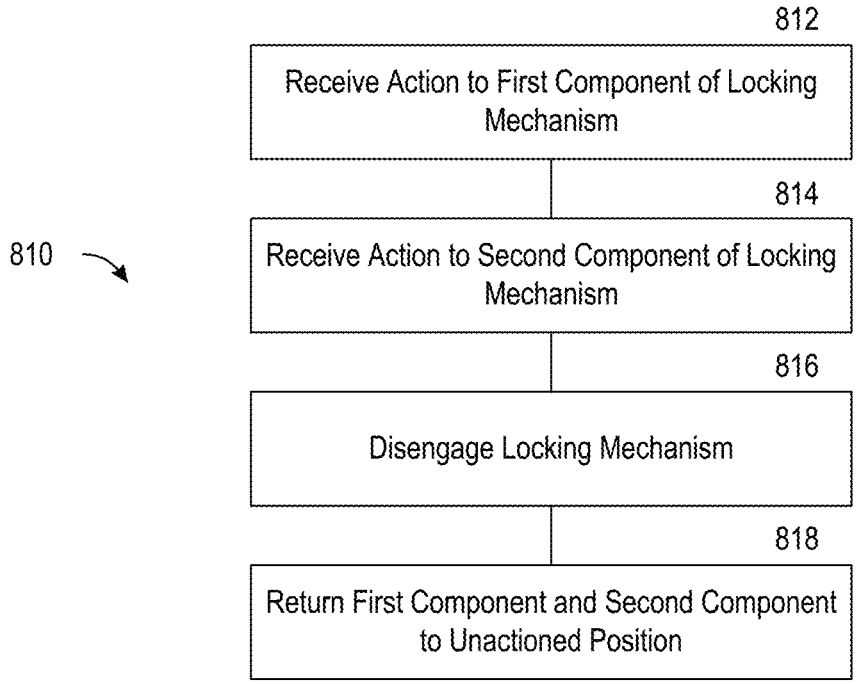

FIG. 8B is a flow diagram of a process 810 for operating a two-stage clasp mechanism in accordance with some embodiments of the present technology. The flow diagram of the process 810 illustrates the process 800 of FIG. 8A from the perspective of any of the clasp mechanisms discussed above with respect to FIGS. 1A-3D.

The process 810 begins at block 812 with receiving a first action to the first component of the locking mechanism. Continuing the example from above, the first component can be the blocking component discussed above with respect to FIGS. 2A-3D. Accordingly, as discussed above, the first action to the first component can be received from the sliding component moving from a first position to a second position on an upper surface of the clasp mechanism. However, similar to the discussion above, it will be understood that the first action (along with the location of the reception of the first action) can vary between embodiments. Purely by way of example, the first action can be received through motion along various other axes and/or can be translated to the blocking component through one or more intermediate components.

At block 814, while maintaining the first component in the actioned position, the process 810 includes receiving a second action to the second component of the locking mechanism. The second component can be the first striker discussed above with respect to FIGS. 2A-3D. Accordingly, as also discussed above, the second action to the second component can be received from the button compressing on a side surface of the clasp mechanism. However, similar to the discussion above, it will be understood that the second action (along with the location of the reception of the second action) can vary between embodiments. Purely by way of example, the second action can be received through motion along various other axes and/or can be translated to the first striker through one or more intermediate components.

At block 816, the process 810 includes disengaging the locking mechanism. The locking mechanism is disengaged by decompressing at least one biasing mechanism to move a first component of the clasp mechanism away from a second portion of the clasp mechanism (e.g., to move the second housing portion away from the first housing portion). As a result, the first striker of the locking mechanism is moved out of range of the second striker, such that the two strikers cannot be rejoined to relock the clasp mechanism.

As discussed above, once the locking mechanism is disengaged, the user can release the first and second components of the locking mechanisms. Once released, at block 818, the process 810 includes returning the first and second components of the locking mechanism to their unactioned positions (e.g., a position associated with the first position of the sliding component and/or the decompressed position of the button). As discussed above, the return can be accomplished by one or more biasing mechanisms within the clasp mechanism that automatically return the components of the locking mechanism to the unactioned positions.

Figure 9:
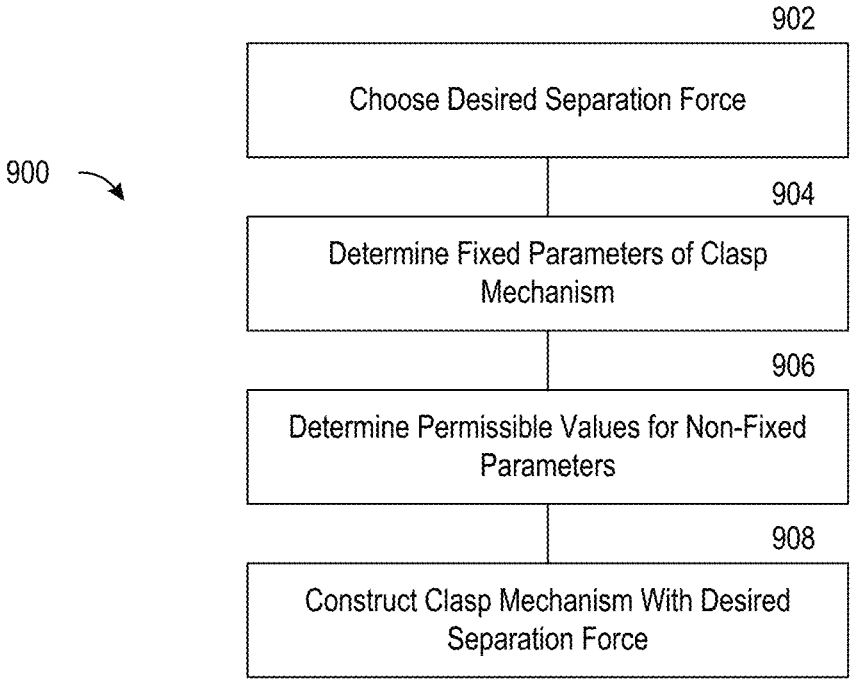
FIG. 9 is a flow diagram of a process for calibrating a breakaway feature of a two-stage clasp mechanism in accordance with some embodiments of the present technology.

FIG. 9 is a flow diagram of a process 900 for calibrating a breakaway feature of a two-stage clasp mechanism in accordance with some embodiments of the present technology. The calibration in the process 900 can be performed before manufacturing, producing, servicing, and/or customizing a two-stage clasp mechanism, such as the clasp mechanism discussed above with respect to FIG. 7.

The process 900 begins at block 902 with choosing a desired separation force for the clasp mechanism. As discussed above, the separation force is the force that must be applied to the clasp mechanism to automatically disengage the locking mechanism of a clasp (e.g., based on break-away features built into the locking mechanism). In some embodiments, the separation force is chosen to reduce the chance of injury associated with the locking mechanism not disengaging (e.g., to limit bodily injury when the user catches straps connected to the clasp mechanism on something). As discussed above, a typical magnitude of the chosen separation force can be between about 2 kg and about 25 kg, or between about 5 kg and about 15 kg. In a specific, non-limiting example, the magnitude of the separation force can be chosen to be about 7 kg.

As discussed above, there are several parameters related to the actual separation force for the locking mechanism, such as the coefficient of static friction between various surfaces of the locking mechanism; the relative slope of the surfaces with respect to each other (e.g., how negative the engagement between the surfaces is); and/or the compressive strength and/or spring constant of the biasing mechanisms coupled to components of the locking mechanism (e.g., impacting the force required to action any of components). Adjusting any of these parameters can impact the actual separation force of the clasp. However, one or more of these parameters may be limited and/or fixed by other design constraints. Purely by way of example, the compressive strength and/or spring constant of the biasing mechanisms coupled to the components of the locking mechanism may be limited (or fully fixed) by a desired resistance when actioning the components. If the spring constant is reduced to lower the separation force, the spring constant may become too low and allow the components to be actioned unintentionally. Conversely, if the spring constant is raised to increase the separation force, the spring constant may become too high, making the components too hard to action.

Accordingly, at block 904, the process includes determining which parameters related to setting the separation force are fixed by other design constraints. This step identifies which parameters cannot be modified to increase and/or decrease the separation force. In some embodiments, this step may also fully limit the range of possible separation forces (e.g., when the only parameters remaining after block 904 offer a limited range of possible separation forces).

At block 906, the process includes determining permissible and/or possible values for the non-fixed parameters.

The identification of permissible values can be dependent on other design constraints (e.g., a range of desired resistances for the biasing mechanisms coupled to the components of the locking mechanism; available space; acceptable materials; and the like). Further, once determined, the range of permissible values can be used to determine one or more combinations of values for non-fixed parameters that provide the desired separation force. In some embodiments, there are numerous possible combinations. Purely by way of example, when the materials can be varied to address friction and the relative angles of surfaces can be adjusted, there can be numerous combinations that provide the desired separation force.

At block 908, the process 900 includes constructing a clasp mechanism with the desired separation force. In some embodiments, block 908 includes choosing between two or more combinations of features.

Examples

The present technology is illustrated, for example, according to various aspects described below. The aspects described below are provided as examples and do not limit the present technology. It is noted that any of the aspects can be combined in any suitable manner except where indicated or directly contradicting.

In some aspects, the techniques described herein relate to a two-stage clasp mechanism, including: a first housing portion, the first housing portion including: a port on a mating face of the first housing portion; and a first striker movably carried by the first housing portion and exposed within the port, wherein the first striker is moveable along a first motion path; and a second housing portion configured to connect to the first housing portion, the second housing portion including: a nose on a mating surface of the second housing portion and configured to be inserted into the port; a second striker carried by the nose, wherein the first striker is configured to move along the first motion path to engage and disengage with the second striker, and wherein engaging the first and second strikers secure the first and second housing portions together; and a blocking component movably carried by the nose, wherein the blocking component is movable along a second motion path between a first state that prevents the first striker from moving and a second state that allows the first striker to move, wherein the second motion path is different from the first motion path.

In some aspects, the techniques described herein relate to a two-stage clasp mechanism wherein: the first housing portion further includes a first action component accessible on a first external surface of the first housing portion and operably coupled to the first striker to move the first striker along the first motion path; and the second housing portion further includes a second action component accessible on a second external surface of the second housing portion and operably coupled to the blocking component to move the blocking component along the second motion path.

In some aspects, the techniques described herein relate to a two-stage clasp mechanism wherein the first external surface and the second external surface are nonadjacent when the first and second housing portions are secured together.

In some aspects, the techniques described herein relate to a two-stage clasp mechanism wherein the first motion path is not parallel to the second motion path.

In some aspects, the techniques described herein relate to a two-stage clasp mechanism wherein the second housing portion further includes a biasing mechanism operably coupled to the blocking component to bias the blocking component along the second motion path toward the first state.

In some aspects, the techniques described herein relate to a two-stage clasp mechanism wherein the first and second strikers engage at an interface, and wherein the interface has a slope configured to transmit at least a portion of a separation force pulling the first and second housing portions apart into moving the first striker along the first motion path to disengage the first and second strikers.

In some aspects, the techniques described herein relate to a two-stage clasp mechanism wherein the slope is calibrated to require the separation force to have a magnitude of at least 7 kg to action the first striker along the first motion path.

In some aspects, the techniques described herein relate to a two-stage clasp mechanism wherein the first striker and the blocking component are in contact at an interface when the first and second strikers are engaged, and wherein the first striker and the blocking component are sloped at the interface to transmit at least a portion of a force pulling the first and second housing portions apart into moving the blocking component along the second motion path.

In some aspects, the techniques described herein relate to a two-stage clasp mechanism wherein the first housing portion further includes an upper component and a lower component, wherein the port is formed into the upper component, wherein the lower portion includes a guiding surface that supports the second housing portion as the nose is inserted into the port, and wherein the lower component separates the port and the nose from a lower surface of the first housing portion.

In some aspects, the techniques described herein relate to a locking mechanism for use in a two-stage clasp, the locking mechanism including: a first striker movably carried by a first housing portion of the two-stage clasp, the first striker movable along a first axis and having a first hook-shaped distal region; a second striker carried by a second housing portion of the two-stage clasp and having a second hook-shaped distal region to engage with the first striker; and a blocking component movably carried by the second housing portion and movable along a second axis, wherein: the first striker is moveable along the first axis between a first position and a second position to engage and disengage with the second striker, and after the first and second strikers are engaged, the blocking component is movable along the second axis between a blocking position that prevents the first striker from moving along the first axis and a release position that allows the first striker to move along the first axis.

In some aspects, the techniques described herein relate to a locking mechanism, further including a sliding component operably coupled to the blocking component and accessible on an outer surface of the second housing portion for a user to action the blocking component between the blocking position and the release position.

In some aspects, the techniques described herein relate to a locking mechanism, further including a biasing mechanism operably coupled to the sliding component to bias the blocking component toward the blocking position.

In some aspects, the techniques described herein relate to a locking mechanism, further including a button operably coupled to the first striker and accessible on an outer surface of the first housing portion for the user to action the first striker between the first position and the second position to disengage the first and second strikers when the blocking component is in the release position.

In some aspects, the techniques described herein relate to a locking mechanism wherein the first axis is orthogonal to the second axis.

In some aspects, the techniques described herein relate to a locking mechanism wherein the first striker and the second striker are negatively engaged and configured to action the first striker along the first axis in response to a separation force on the first and second housing portions having predetermined magnitude.

In some aspects, the techniques described herein relate to a locking mechanism wherein: the first striker is positioned within a receiving port on the first housing portion; the second striker is integrally formed into a nose on the second housing portion, wherein the nose is insertable into the receiving port; a distal region of the second striker has a sloped surface positioned to push the first striker along the first axis as the nose is inserted into the receiving port; and a distal end of the blocking component has an impact surface positioned to be impacted by the first striker as the nose is inserted into the receiving port to push the blocking component along the second axis.

In some aspects, the techniques described herein relate to a child-proof clasp mechanism, including: a first component having a first mating surface, the first component including: a first opening in the first mating surface; and a first striker movably carried by the first component within the opening, wherein the first striker is moveable along a first path; and a second component having a second mating surface, the second component including: a nose protruding from the second mating surface and configured to be inserted into the first opening, wherein the nose includes a second opening positioned to receive at least a portion of the first striker when the nose is inserted into the first opening; a second striker carried by the nose and configured to engage with the first striker, wherein engaging the first second strikers secures the first and second components together; and a blocking component movably carried by the nose within the second opening, wherein the blocking component is movable along a second path between a first state configured to prevent the first striker from moving along the first path and a second state configured to allow the first striker to move along the first path.

In some aspects, the techniques described herein relate to a child-pro 17 wherein: the second component further includes a slider accessible on an upper surface of the second component, wherein the slider is movable between a locked position and a release position, and wherein the slider is operably coupled to the blocking component so that: when the slider is in the locked position, the blocking component is in the first state; and when the slider is in the release position, the blocking component is in the second state; and the first component further includes an actionable component accessible on a side surface of the first component, wherein the actionable component is coupled to the first striker to allow a user to push the first striker along the first path when the slider is in the release position to disengage the first and second strikers.

In some aspects, the techniques described herein relate to a child-pro 17 wherein the first striker has a first hooked shape, wherein the second striker has a second hooked shape configured to engage with the first hooked shape and a distal portion having a sloped surface, and wherein the sloped surface on the distal portion is positioned to push the first striker in along the first path while the nose is inserted into the first opening.

In some aspects, the techniques described herein relate to a child-pro 17 wherein second component further includes a biasing element operably coupled to the blocking component to bias the blocking component toward the first state, and wherein the blocking component has an engaging surface positioned to press the first striker against the second striker when the blocking component is in the first state.

Conclusion

From the foregoing, it will be appreciated that specific implementations of the technology have been described herein for purposes of illustration, but well-known structures and functions have not been shown or described in detail to avoid unnecessarily obscuring the description of the implementations of the technology. To the extent any material incorporated herein by reference conflicts with the present disclosure, the present disclosure controls. Where the context permits, singular or plural terms may also include the plural or singular term, respectively. Moreover, unless the word "or" is expressly limited to mean only a single item 30xclusivee From the other items in reference to a list of two or more items, then the use of "or" in such a list is to be interpreted as including (a) any single item in the list, (b) all of the items in the list, or (c) any combination of the items in the list. Furthermore, as used herein, the phrase "and/or" as in "A and/or B" refers to A alone, B alone, and both A and B. Additionally, the terms "comprising," "including," "having," and "with" are used throughout to mean including at least the recited feature(s) such that any greater number of the same features and/or additional types of other features are not precluded. Further, the terms "approximately" and "about" are used herein to mean within at least within 10 percent of a given value or limit. Purely by way of example, an approximate magnitude of a force means within a ten percent of the given force magnitude.

From the foregoing, it will also be appreciated that various modifications may be made without deviating from the disclosure or the technology. For example, one of ordinary skill in the art will understand that various components of the technology can be further divided into subcomponents, or that various components and functions of the technology may be combined and integrated. In addition, certain aspects of the technology described in the context of particular implementations may also be combined or eliminated in other implementations. Furthermore, although advantages associated with certain implementations of the technology have been described in the context of those implementations, other implementations may also exhibit such advantages, and not all implementations need necessarily exhibit such advantages to fall within the scope of the technology. Accordingly, the disclosure and associated technology can encompass other implementations not expressly shown or described herein.

We claim:

1. A two-stage clasp mechanism, comprising:

a first mating component, the first mating component comprising a first striker moveable along first and second motion paths; and a second mating component couplable to the first mating component, the second mating component comprising:

a second striker carried by the second mating component and positioned to engage the first striker when the second mating component is coupled to the first mating component, wherein the first striker is configured to move along the first and second motion paths to engage and disengage with the second striker; and a blocking component movably carried by the second mating component, wherein the blocking component is movable along a third motion path between a first state and a second state, wherein the third motion path is different from both of the first and second motion paths, and wherein, when the first and second strikers are engaged:

in the first state, the blocking component is positioned to obstruct movement of the first striker, and in the second state, the blocking component is positioned to allow the first striker to move.

2. The two-stage clasp mechanism of claim 1 wherein:

the first mating component further comprises a first actionable component accessible on an external surface of the first mating component, wherein the first actionable component is operably coupled to the first striker to move the first striker along the second motion path; and the second mating component further comprises a second actionable component accessible on an external surface of the second mating component, wherein the second actionable component is operably coupled to the blocking component to move the blocking component along the third motion path.

3. The two-stage clasp mechanism of claim 2 wherein the external surface of the first mating component and the external surface of the second mating component are non-adjacent when the second mating component is coupled to the first mating component.

4. The two-stage clasp mechanism of claim 1 wherein the third motion path is at a non-zero angle with respect to both of the first and second motion paths.

5. The two-stage clasp mechanism of claim 1 wherein:

the first striker is movable along the first motion path between a first position and a second position; and the first mating component further comprises a biasing component positioned to bias the first striker toward the first position to engage with the second striker when the second mating component is coupled with the first mating component.

6. The two-stage clasp mechanism of claim 1 wherein:

the first mating component further comprises a first housing having a port, wherein the first striker is movably carried by the first housing within the port; and the second mating component further comprises a second housing having a nose, wherein the nose includes an opening positioned to receive the first striker when the nose is inserted into the port, and wherein the second striker is integrated with the nose.

7. The two-stage clasp mechanism of claim 6 wherein the blocking component is movably carried by the second housing at least partially within the opening of the nose.

8. The two-stage clasp mechanism of claim 1 wherein:

the first striker and the second striker are positioned to engage at a first interface when the second mating component is coupled to the first mating component, wherein the first interface is sloped to transmit at least a portion of a separation force into a first disengagement force to move the first striker along the second motion path; and the first striker and the blocking component are positioned to engage at a second interface when the second mating component is coupled to the first mating component, wherein the second interface is sloped to transmit at least a portion of the separation force into a second disengagement force to move the blocking component along the third motion path.

9. The two-stage clasp mechanism of claim 1 wherein the second mating component further comprises a biasing component positioned to bias the blocking component toward the first state to prevent the first striker from moving when the second mating component is coupled with the first mating component.

10. A wearable device, comprising:

an electronics housing;

a clasp mechanism comprising:

a first housing portion coupled to a first strap portion;

a second housing portion coupled to a second strap portion and configured to engage with the first housing portion; and a two-stage locking mechanism split between the first housing portion and the second housing portion, the two-stage locking mechanism comprising:

a first component actionable along a first axis; and a second component actionable along a second axis different from the first axis, wherein, when the first and second housing portions are engaged, the second component is movable between a first state preventing the first component from moving along the first axis and a second state allowing the first component to move along the first axis.

11. The wearable device of claim 10, wherein:

the first component includes a first striker carried by a first housing portion;

the two-stage locking mechanism further comprises a second striker carried by the second housing portion, wherein the first striker is movable along the first axis to engage and disengage with the second striker; and the second component includes a blocking component movable along the second axis, wherein:

when the second component is in the first state, the blocking component is in a blocking position that prevents the first striker from moving along the first axis, and when the second component is in the second state, the blocking component is in a release position that allows the first striker to move along the first axis.

12. The wearable device of claim 10 wherein the first component and the second component are negatively engaged and configured to action the second component along the second axis from the first state to the second state in response to a separation force on the first and second housing portions above a threshold magnitude.

13. The wearable device of claim 10 wherein the two-stage locking mechanism further comprises a release component accessible on an external surface of the second housing portion and operably coupled to the second component to move the second component along the second axis.

14. The wearable device of claim 10 wherein the first housing portion includes an upper section and a lower section, wherein first component is movably carried by the upper section, and wherein, when the first housing portion is coupled to the second housing portion:

the lower section at least partially supports the second housing portion, and the lower section is positioned between the two-stage locking mechanism and a lowermost surface of the first housing portion.

15. A locking mechanism for use in a two-stage clasp, the locking mechanism comprising:

a first component movably carried by a first housing portion of the two-stage clasp, the first component movable along first and second motion paths to engage and disengage the first housing portion to a second housing portion of the two-stage clasp; and a second component movably carried by the second housing portion and movable along a third motion path different from both of the first and second motion paths, wherein, when the first housing portion is engaged to the second housing portion, the second component is movable along the third motion path between a first position preventing the first component from moving along the second motion path and a second position allowing the first component to move along the second motion path.

16. The locking mechanism of claim 15 wherein:

the first component includes a first striker carried by a first housing portion;

the locking mechanism further comprises a second striker carried by the second housing portion, wherein the second striker is positioned to engage with the first striker when the first housing portion is engaged with the second housing portion; and the second component includes a blocking component movable along the third motion path, wherein:

when the second component is in the first position, the blocking component is in a blocking position that prevents the first striker from moving along the second motion path, and when the second component is in the second position, the blocking component is in a release position that allows the first striker to move along the second motion path.

17. The locking mechanism of claim 16 wherein:

the first striker has a first hook-shaped distal region;

the second striker has a second hook-shaped distal region; and when the first housing portion is engaged with the second housing portion, the first and second hook-shaped distal regions are negatively engaged and configured to push the first striker component along the second motion path in response to a separation force on the first and second housing portions above a threshold magnitude.

18. The locking mechanism of claim 15, further comprising a release component accessible on an external surface of the second housing portion and operably coupled to the second component to move the second component along the third motion path.

19. The locking mechanism of claim 15, further comprising a release component accessible on an external surface of the first housing portion and operably coupled to the first component to move the first component along the second motion path.

20. The locking mechanism of claim 15, further comprising a biasing mechanism carried by the second housing portion and operatively coupled to the second component to bias the second component toward the first position when the first and second housing portions are engaged.

* * * * *